US008463164B2

(12) United States Patent
Nagashima et al.

(10) Patent No.: US 8,463,164 B2
(45) Date of Patent: Jun. 11, 2013

(54) DEVELOPER SUPPLY CONTAINER INCLUDING PROJECTION FOR REGULATING MOUNTING ATTITUDE

(75) Inventors: Toshiaki Nagashima, Moriya (JP); Katsuya Murakami, Toride (JP); Ayatomo Okino, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/353,655

(22) Filed: Jan. 19, 2012

(65) Prior Publication Data

US 2012/0134719 A1 May 31, 2012

Related U.S. Application Data

(62) Division of application No. 11/719,361, filed as application No. PCT/JP2006/304819 on Mar. 6, 2006, now Pat. No. 8,190,068.

(30) Foreign Application Priority Data

Mar. 4, 2005 (JP) ..... 2005-060317
Nov. 30, 2005 (JP) ..... 2005-345485

(51) Int. Cl.
*G03G 15/08* (2006.01)

(52) U.S. Cl.
USPC ..... 399/262; 399/263

(58) Field of Classification Search
USPC ..... 399/258, 262, 263
See application file for complete search history.

(56) References Cited

U.S. PATENT DOCUMENTS

| | | | |
|---|---|---|---|
| 5,036,341 | A | 7/1991 | Larsson |
| 5,235,389 | A | 8/1993 | Kikuchi et al. |
| 5,593,068 | A | 1/1997 | Kitayama et al. |
| 5,797,073 | A | 8/1998 | Russell |

(Continued)

FOREIGN PATENT DOCUMENTS

| | | |
|---|---|---|
| EP | 0670530 A2 | 9/1995 |
| EP | 0670530 B1 | 5/2000 |

(Continued)

OTHER PUBLICATIONS

Chinese Notification of First Office Action dated Aug. 29, 2008, in Chinese Application No. 200680001423.9.

(Continued)

*Primary Examiner* — David Gray
*Assistant Examiner* — Laura Roth
(74) *Attorney, Agent, or Firm* — Fitzpatrick, Cella, Harper & Scinto

(57) ABSTRACT

A developer supply container is mountable to a developer receiving apparatus including a driving gear, and includes a developer discharging opening; a feeding blade for feeding the developer toward the opening when the container is positioned at a developer discharging position; a drive receiving gear engageable with the driving gear for rotating the feeding blade; a regulating projection for regulating a mounting attitude of the container to prevent engagement between the drive receiving and driving gears. Upon mounting the container, the drive receiving gear is revolvable, with manual rotation of the container, about a rotation center of the container to a set position where the drive receiving gear engages with the driving gear; and a load applier for applying a load to the drive receiving gear to rotate the container from the set position to the discharging position by the rotational force received by the drive receiving gear.

9 Claims, 33 Drawing Sheets

U.S. PATENT DOCUMENTS

| | | | | |
|---|---|---|---|---|
| 5,832,343 | A | 11/1998 | Kobayashi et al. | |
| 5,842,093 | A | 11/1998 | Tanda | |
| 6,704,533 | B2 | 3/2004 | Isomura et al. | |
| 6,788,912 | B2 | 9/2004 | Isomura et al. | |
| 6,985,686 | B2 | 1/2006 | Okino et al. | |
| 7,266,330 | B2 | 9/2007 | Murakami et al. | |
| 7,412,192 | B2 | 8/2008 | Nakajima et al. | |
| 7,764,909 | B2 | 7/2010 | Nakajima et al. | |
| 7,773,919 | B2 | 8/2010 | Nakajima et al. | |
| 7,796,923 | B2 | 9/2010 | Nakajima et al. | |
| 7,848,685 | B2 | 12/2010 | Nagashima et al. | |
| 7,957,679 | B2 | 6/2011 | Nakajima et al. | |
| 8,131,189 | B2 | 3/2012 | Nakajima et al. | |
| 8,190,068 | B2 * | 5/2012 | Nagashima et al. | 399/262 |
| 2004/0208668 | A1 | 10/2004 | Kurihara et al. | |
| 2005/0008400 | A1 | 1/2005 | Tazawa et al. | |
| 2005/0271426 | A1 | 12/2005 | Okino et al. | |
| 2006/0104671 | A1 | 5/2006 | Murakami et al. | |
| 2006/0193658 | A1 | 8/2006 | Sato | |
| 2007/0036565 | A1 | 2/2007 | Okino et al. | |
| 2007/0280743 | A1 | 12/2007 | Nakajima et al. | |
| 2008/0304870 | A1 | 12/2008 | Nakajima et al. | |
| 2008/0304871 | A1 | 12/2008 | Nakajima et al. | |
| 2008/0304872 | A1 | 12/2008 | Nakajima et al. | |
| 2010/0278565 | A1 | 11/2010 | Nakajima et al. | |
| 2011/0194876 | A1 | 8/2011 | Nakajima et al. | |
| 2012/0114393 | A1 | 5/2012 | Nakajima et al. | |

FOREIGN PATENT DOCUMENTS

| | | | |
|---|---|---|---|
| EP | 1437632 | A1 | 7/2004 |
| EP | 1533664 | A1 | 5/2005 |
| EP | 1 818 729 | A1 | 8/2007 |
| JP | 53-46040 | A | 4/1978 |
| JP | 3-288875 | A | 12/1991 |
| JP | 6-35321 | A | 2/1994 |
| JP | 2003-107892 | A | 4/2003 |
| JP | 2004-170747 | A | 6/2004 |
| RU | 2057028 | C1 | 3/1996 |

OTHER PUBLICATIONS

Decision on Grant—Patent for Invention dated Mar. 25, 2010, in Russian Application No. 2007136793/28.

Communication pursuant to Article 94(3) EPC dated Jun. 9, 2011, in European Application No. 06 715 570.5-2225.

Notice of Preliminary Rejection dated May 25, 2012, in Korean Application No. 10-2011-7005298.

Communication pursuant to Article 94(3) EPC dated Jun. 26, 2012, in European Application No. 06 715 570.5-2225.

Communication dated Jun. 28, 2012, forwarding a European Search Report dated Jun. 20, 2012, in European Application No. 11192821.4-2225/2428849.

Communication dated Jun. 28, 2012, forwarding a European Search Report dated Jun. 20, 2012, in European Application No. 11192824.8-2225/2428850.

Communication dated Jun. 28, 2012, forwarding a European Search Report dated Jun. 20, 2012, in European Application No. 11192828.9-2225/2428851.

Office Action dated May 25, 2012 in Korean Application No. 10-2007-7020113.

Notice of Preliminary Rejection dated May 25, 2012 in Korean Application No. 10-2011-7005299.

Communication dated Mar. 13, 2013, in European Application No. 11 192 828.9-1910.

* cited by examiner (a)

(b)

(a)

(b)

DEVELOPER SUPPLY CONTAINER INCLUDING PROJECTION FOR REGULATING MOUNTING ATTITUDE

This application is a divisional of U.S. patent application Ser. No. 11/719,361, filed May 15, 2007, and having a 35 U.S.C. 371 (c) date of Feb. 26, 2009, which is a National Phase of International Application No. PCT/JP2006/304819, filed Mar. 6, 2006.

TECHNICAL FIELD

The present invention relates to a developer supply container for supplying the developer and a developer receiving apparatus for receiving the developer from the developer supply container. Such a developer receiving apparatus is usable with a copying machine, a facsimile, a printer or other image forming apparatuses, and an image forming unit detachably mountable to the image forming apparatus.

BACKGROUND ART

Conventionally, toner in the form of fine powder is used as a developer for image formation in the image forming apparatus such as an electrophotographic copying machine, a printer or the like. It is also conventional that toner is supplied from a toner supply container exchangeably set in the image forming apparatus with consumption of the toner in the image forming apparatus.

Since the toner is very fine powder, the toner may scatter around if the handling in the toner supplying operation is not proper. For this reason, it is proposed and implemented to keep the toner supply container set within the image forming apparatus, and the toner is discharged gradually through a small opening.

In such a conventional toner supply container, a structure has been proposed in which a gear for driving a toner stirring and feeding member provided in the toner supply container receives a driving force through a driving connection from a gear provided in the image forming apparatus side.

For example, in Japanese Laid-open Patent Application Hei 3-288875, a toner supply container in the form of a dual cylinder including an inner cylinder and an outer cylinder is proposed, wherein a stirring member is disposed in the inner cylinder, and the outside is provided with a gear for driving the stirring member. When such a toner supply container is inserted into the main assembly of the image forming apparatus in the longitudinal direction thereof, a gear provided in the inner cylinder is engaged with the gear provided in the main assembly side of the image forming apparatus. After the engagement is established, only the outer cylinder is rotated through approx. 90°, by which openings of the outer cylinder and the inner cylinder are aligned with each other, and are also aligned with an opening provided in the main assembly side of the image forming apparatus, thus enable the toner supply or replenishment.

However, in such a conventional example, when the operator inserts the toner supply container into the image forming apparatus in the longitudinal direction of the toner supply container, the teeth of the gear in the toner supply container and the teeth gear in the image forming apparatus side may abut each other. If this occurs, the durability of the gears may deteriorate, or in the worst case, the gear or gears may be broken. Particularly, the gear in the image forming apparatus side repeatedly receives the gear of the toner supply container each time the toner supply container is exchanged or reset, and therefore, the problem of the teeth abutment is significant.

This problem may lead to improper toner supply and to a malfunction which requires interruption of the image formation.

DISCLOSURE OF THE INVENTION

Accordingly, it is a principal object of the present invention to provide a developer supply container with which a deterioration of a drive transmission member can be suppressed.

It is another object of the present invention to provide a developer supply container which is contributable to suppression to a deterioration of a driving gear of a developer receiving apparatus.

It is a further object of the present invention to provide a toner supply container which can properly supply the developer.

It is a further object of the present invention to provide a developer receiving apparatus with which a deterioration of a driving gear or a drive transmission member can be suppressed.

According to an aspect of the present invention, there is provided a developer supply container detachably mountable to a developer receiving apparatus, wherein developer supply container mounted to said developer receiving apparatus is set to a set position by an operator rotating said developer supply container in a setting direction, said developer supply container comprising a containing portion for containing a developer; a rotatable discharging member for discharging the developer out of said containing portion; and a drive transmission member for engagement with a driving gear provided in said developer receiving apparatus to transmit a driving force to said discharging member, wherein said drive transmission member is revolved to a position where said drive transmission member is engageable with the driving gear, by rotation of said developer supply container to the set position by the rotating operation of the operator; wherein said drive transmission member is loaded to rotate said developer supply container placed at the set position to a developer discharging position in the setting direction when said drive transmission member receives a driving force.

According to another aspect of the present invention, there is provided a developer supply container detachably mountable to a developer receiving apparatus, wherein developer supply container mounted to said developer receiving apparatus is set to a set position by an operator rotating said developer supply container in a setting direction, said developer supply container comprising: a containing portion for containing a developer; a rotatable discharging member for discharging the developer out of said containing portion; and a drive transmission member for engagement with a driving gear provided in said developer receiving apparatus to transmit a driving force to said discharging member, wherein said drive transmission member is revolved to a position where said drive transmission member is engageable with the driving gear, by rotation of said developer supply container to the set position by the rotating operation of the operator; causing means for causing said developer supply container placed at the set position to rotate to a developer discharging position in the setting direction.

According to a further aspect of the present invention, there is provided a developer supply container detachably mountable to a developer receiving apparatus, wherein developer supply container mounted to said developer receiving apparatus is set to a set position by an operator rotating said developer supply container in a setting direction, said developer supply container comprising a cylindrical portion for containing a developer; a rotatable discharging member for discharging the developer out of said cylindrical portion; and a drive transmission member for engagement with a driving gear provided in said developer receiving apparatus to transmit a driving force to said discharging member; a regulating member for regulating a mounting attitude of said developer supply container to said developer receiving apparatus so as to prevent engagement between said drive transmission member and said driving gear; and wherein said drive transmission member is so disposed that by the rotating operation of said developer supply container toward the setting position about a center of said cylindrical portion.

According to a further aspect of the present invention, there is provided a developer supply container detachably mountable to a developer receiving apparatus, said developer supply container comprising: a containing portion for containing a developer; a rotatable discharging member for discharging the developer out of said containing portion; and a plurality of engaging members, which are engaged with each other, for transmitting a rotating force from a driving gear provided in said developer receiving apparatus to said discharging member.

According to a further aspect of the present invention, there is provided a developer receiving apparatus for receiving a developer from a developer supply container which comprises a cylindrical portion for containing a developer, a rotatable discharging member for discharging the developer out of said cylindrical portion, and a drive transmission member for transmitting a rotating force to said discharging member, said developer receiving apparatus comprising:

a mounting portion for detachably mounting said developer supply container, wherein said mounting portion permits said developer supply container to rotate about a center of said cylindrical portion; a driving gear engageable with said drive transmission member; a regulating member for regulating a mounting attitude of said developer supply container to said mounting portion so as to prevent engagement between said drive transmission member and said driving gear; and wherein said drive transmission member is so disposed that by rotation of said developer supply container, said drive transmission member is engaged with said driving gear.

These and other objects, features and advantages of the present invention will become more apparent upon a consideration of the following description of the preferred embodiments of the present invention taken in conjunction with the accompanying drawings.

BEST MODE FOR CARRYING OUT THE INVENTION

The preferred embodiments of the present invention will be described in conjunction with the accompanying drawing.

[Embodiment 1]

(Image Forming Apparatus)

A toner supply container of Embodiment 1 (so-called toner cartridge) is loaded into a toner receiving apparatus of an image forming apparatus which is a copying machine of an electrophotographic type in the embodiment.

Figure 1:
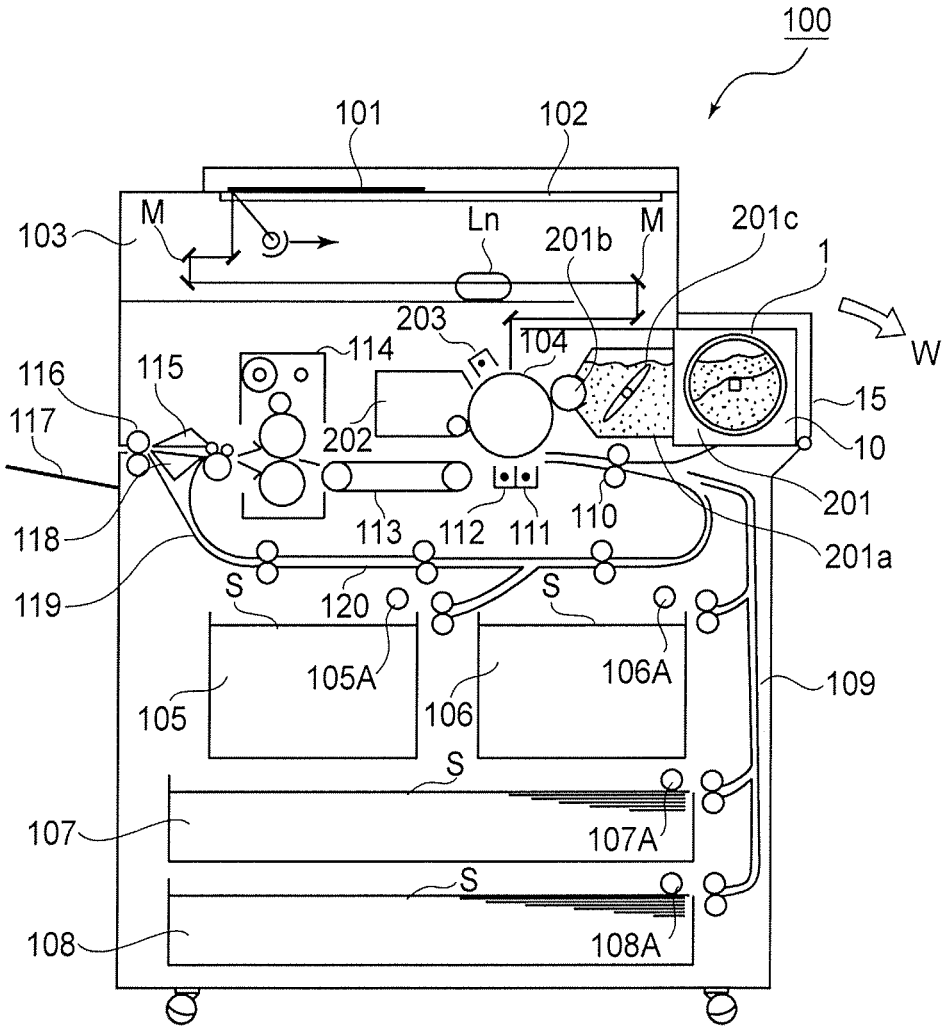
FIG. 1 is a sectional view illustrating a general arrangement of an image forming apparatus.

FIG. 1 is illustrates such a copying machine.

In this Figure, designated by 100 is a main assembly of the electrophotographic copying machine. Designated by 101 is an original placed on an original supporting platen glass 102. A light image indicative of image information is projected on an image bearing member in the form of an electrophotographic photosensitive drum 104 through mirrors M and a lens Ln of an optical portion 103. Designated by reference numerals 105-108 are sheet cassettes. A proper sheet is selected from sheet size information of the cassettes 105-108, correspondingly to the sheet size of the original 101 or to the information inputted by the user at the operating portion, and proper sheet is picked up from one of the cassettes 105-108. The recording material is not limited to a sheet, but may be an OHP sheet or the like.

One sheet S picked up and fed out by the feeding and separating device 105A-108A is fed to a registration roller 110 through a feeding portion 109, and is fed in synchronizm with the timing of the scanning operation of the optical portion 103 and the rotation of the photosensitive drum 104. Designated by 111, 112 are a transfer discharger, and a separation discharger. The image of toner formed on the photosensitive drum 104 is transferred onto a sheet S by the transfer discharger 111. The separation discharger 112 functions to separate the sheet S having the toner image transferred thereto from the photosensitive drum 104.

Thereafter, the sheet S fed by the feeding portion 113 is subjected to the heat and the pressure at the fixing portion 114 by which the toner image is fixed on the sheet. In the case of a simplex copy (one side copy), the sheet S is discharged onto the discharging tray 117 by discharging rollers 116 through a discharging/reversing portion 115. In the case of a superimposed copy mode, the sheet S is fed back to the registration roller 110 by way of re-feeding feeding portions 119, 120 by controlling a flapper 118 of a discharging/reversing portion 115, and then, the sheet is discharged to the discharging tray 117 through the path along which the sheet is fed in the case of the one-sided copy.

In the case of the duplex copy, the sheet S is once discharged partly by the discharging rollers 116 through the discharging/reversing portion 115. Then, after the terminal end of the sheet S passes by way of the flapper 118, and while the sheet S is still nipped by the discharging rollers 116, the flapper 118 is controlled, and simultaneously, the discharging roller 116 is rotated in the opposite direction to feed the sheet S back into the apparatus. Thereafter, the sheet S is fed to the registration roller 110 by way of the re-feeding feeding portion 119, 120, and then, the sheet S is discharged to the discharging tray 117 along the same path as with the one-sided copy.

In the main assembly of the apparatus 100, there are provided, around the photosensitive drum 104, process means including a developing device 201 (developing means), a cleaner portion 202 (cleaning means), a primary charger 203 (charging means) and the like. The cleaner portion 202 functions to remove the toner remaining on the photosensitive drum 104. The primary charger 203 functions to electrically charge the surface of the photosensitive drum to a uniform potential in preparation for the formation of the electrostatic image on the photosensitive drum 104.

(Developing Device)

Figure 2:
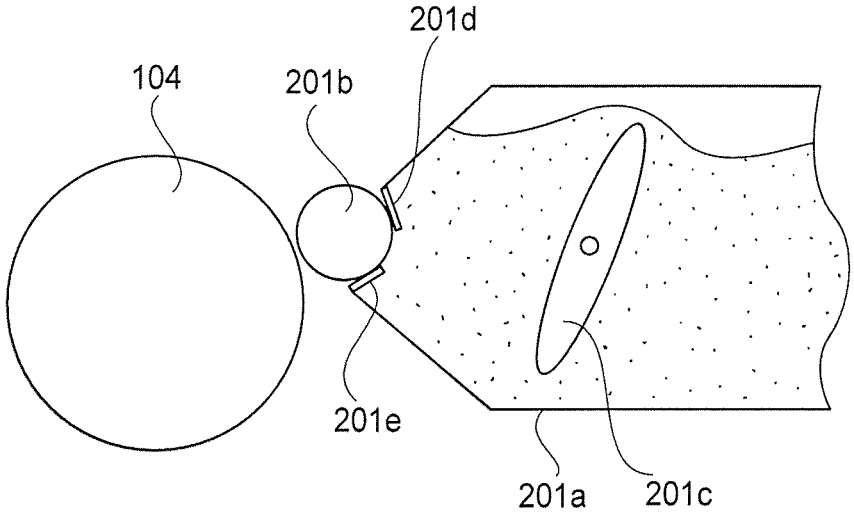
FIG. 2 is a partially sectional view of a developing device.

FIG. 2 shows a developing device 201 and the photosensitive drum 104.

The developing device 201 functions to develop with toner the electrostatic latent image formed on portion 103 corresponding to the information of the original 101. In order to supply the toner into the developing device 201, there is provided a toner supply container 1 which is detachably mountable by the user.

The developing device 201 comprises a toner receiving apparatus 10 to which the toner supply container 1 is demountably mounted, and a developing device 201*a*. The developing device 201*a* comprises a developing roller 201*b* and a feeding member 201*c*. The toner supplied from the toner supply container 1 is fed to the developing roller 201*b* by a feeding member 201*c*, and is supplied onto the photosensitive drum 104 by the developing roller 201*b*. As shown in FIG. 2, there are provided a developing blade 201*d* which is a regulating member for regulating an amount of toner coating on the developing roller 201*b*, and a toner blow preventing sheet 201*e* (toner leakage preventing member) contacted to the developing roller to prevent the toner leakage through the gap between the developing device 201*a* and the developing roller 201*b*.

As shown in FIG. 1, there is provided a cover 15, which is a part of an outer casing, for exchange of the toner supply container. When the user mounts the toner supply container 1 to the main assembly of the apparatus 100 or when the user dismounts the toner supply container 1 from the main assembly of the apparatus 100, the cover 15 is opened by rotation in the direction of an arrow W in FIG. 1.

(Toner Supply Container)

Figure 3:
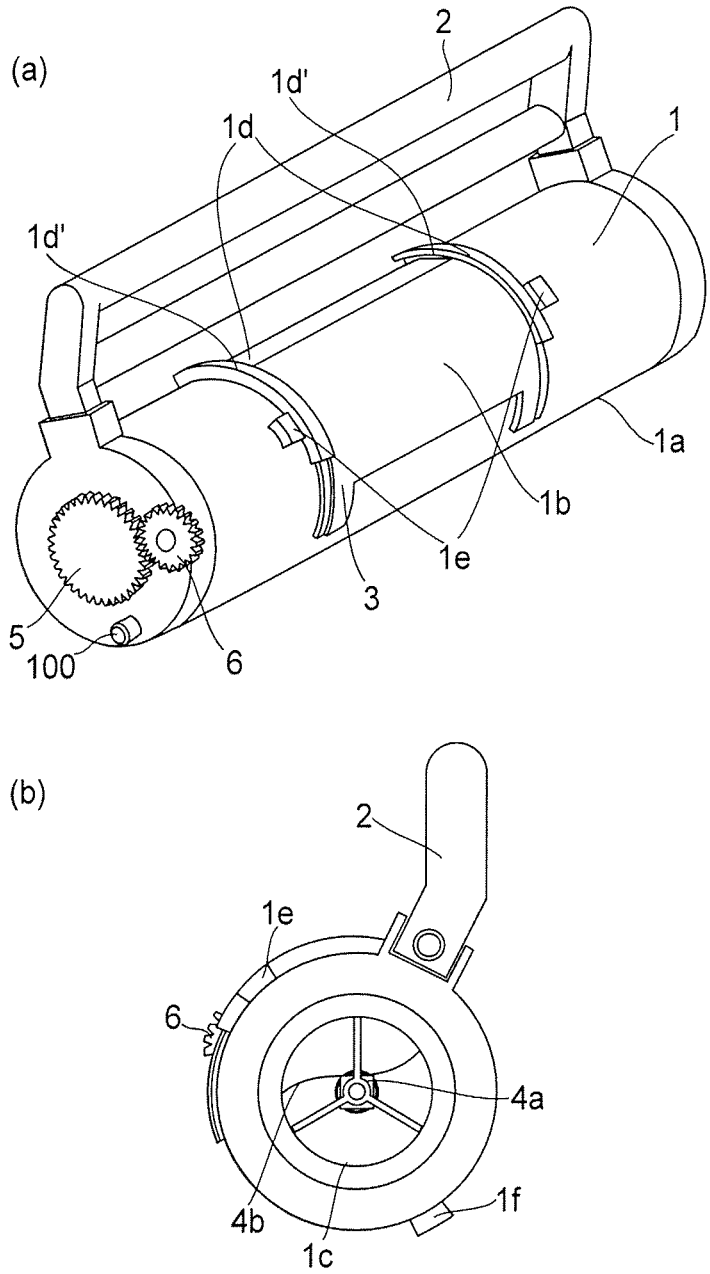
FIG. 3 illustrates a toner supply container, wherein (a) is a perspective view thereof, and (b) is a side view thereof.

Referring to FIG. 3, the structure of the toner supply container 1 of this embodiment will be described. In FIG. 3, (a), the toner supply container is shown in a perspective view, and (b) is a view as seen from the outside of a filling port of the toner supply container.

The container body 1*a* functioning to accommodate the toner (containing portion) is generally cylindrical. In the peripheral surface of the container body 1*a*, a toner discharge opening 1*b* is formed in the form of a slit extending in the longitudinal direction of the container 1.

The toner discharge opening 1*b*, as will be described hereinafter, is directed in a horizontal direction when the toner supply container is mounted to the main assembly of the image forming apparatus, and is rotated through a predetermined angle, that is, when the rotation of the toner supply container to the toner supply position is completed where the toner supply is enabled.

The container body 1*a* is required to have a certain degree of rigidity from the standpoint of protecting the toner therein during transportation and the prevention of the leakage of the toner therefrom, and therefore, it is molded through an injection molding from polystyrene material.

The outer surface of the container body 1*a* is provided with a handle 2 (grip member) for facilitating the supplying operation of the user (operator) from the toner supply container 1 into a toner receptor. The handle 2 is required to have a sufficient rigidity from the same standpoint, and therefore, is also molded through the injection molding from the same material as the container body 1*a*.

The handle 2 may be fixed to the container body 1*a* by mechanical engagement, screwing, bonding, welding or any other way if the sufficient strength is assured so that it is secured against the force applied upon the supplying operation. The integral molding of the container body 1*a* and the handle 2 is desirable from the standpoint of the strength and the manufacturing cost.

The end of the container body 1*a* opposite from the end where a second gear 5 is provided, a toner filling opening 1*c* is formed, and is sealed by a cap (sealing member) after the toner filling into the container body. The second gear 5 will be described in detail hereinafter.

Figure 5:
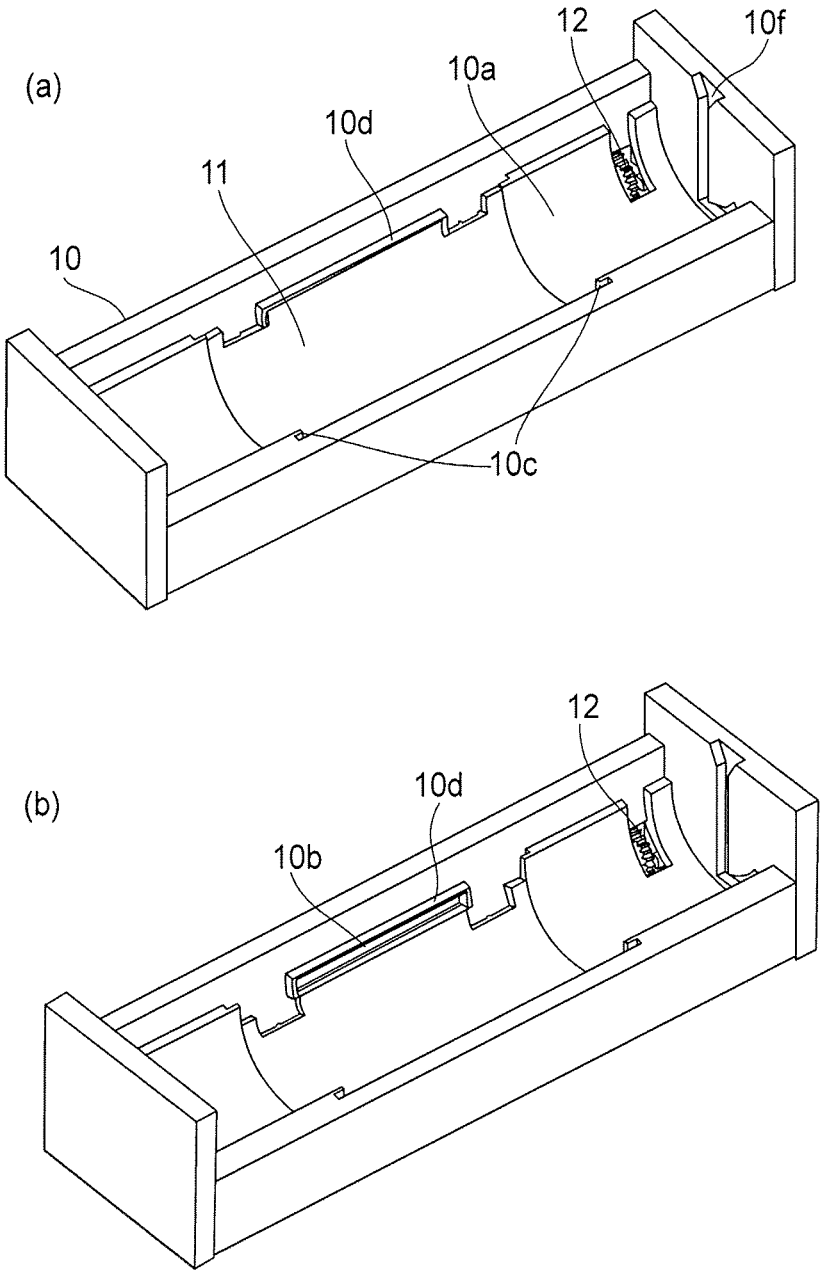
FIG. 5 illustrates a toner receiving apparatus, wherein (a) is a perspective view thereof upon sealing a toner receiving opening, and (b) is a perspective view thereof upon unsealing of the toner receiving opening.

One end surface of the container body 1*a* is provided with a regulated projection 100 (member to be regulated) as shown in FIG. 3 to regulate the mounting attitude (angle) of the toner supply container relative to the toner receiving apparatus. On the other hand, the toner receiving apparatus is provided with a regulating recess 10*f* (regulating member) for guiding the regulated projection, as shown in FIG. 5, to regulate the mounting attitude of the toner supply container. The recess is such that it does not interfere with the projection at the time when the toner supply container is properly mounted in the toner receiving apparatus.

(Feeding Member in the Toner Supply Container)

Figure 4:
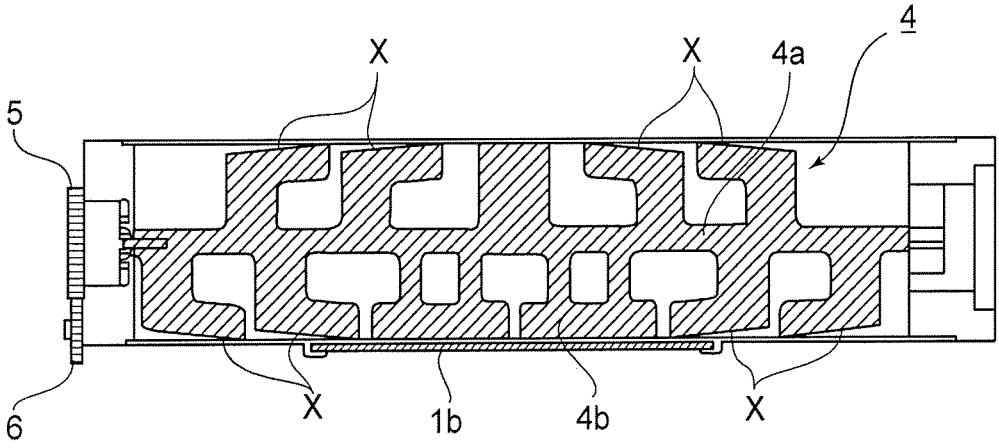
FIG. 4 illustrates a structure of a feeding member in the toner supply container.

Referring to FIG. 4, a structure of a feeding member 4 will be described. FIG. 4 is a lateral view of an inside of the toner supply container.

In the container body 1*a*, the feeding member 4 (discharging member) is provided to feed the toner from the lower part to the upper part toward the toner discharge opening 1*b* while stirring the toner in the container by rotation relative to the container body 1*a*.

As shown in FIG. 4, the feeding member 4 mainly comprises a stirring shaft 4*a* and stirring blades 4*b*. One longitudinal end of the stirring shaft 4*a* is rotatably supported by the container body 1*a* so that it is not movable in the axial direction of the stirring shaft 4*a*. On the other hand, the other longitudinal end of the stirring shaft 4*a* is coaxially connected with a first gear 5 which will be described in detail hereinafter. More particularly, they are connected with each other by engaging a shaft portion of the first gear 5 with the other end of the stirring shaft 4*a* in the container body.

Around the shaft portion, there is provided a sealing member to prevent leakage of the toner to an outside of the container around the shaft portion of the first gear 5. The first gear 5 and the stirring shaft 4*a* may not directly be connected with each other, but they may be co-axially connected through another member or other members.

The stirring shaft 4*a* is required to have a sufficient rigidity to particulate, when the toner is agglomerated, the toner and to feed and discharge it, and therefore, in this embodiment, it is made of polystyrene and polyacetal material which is desirable.

The stirring blades 4*b* are fixed on the stirring shaft 4*a*, and with the rotation of the stirring shaft 4*a*, the toner in the container is particulated, stirred and fed toward the toner discharge opening 1*b*. In order to reduce the amount of toner remaining in the toner supply container, the stirring blade 4*b* slides on the inner surface of the container. In other words, the length of the extensions of the stirring blades from the stirring shaft is selected in consideration of the inner diameter of the container.

As shown in FIG. 4, the stirring blades have L-shaped portions which are provided with inclined portions X which provides a function to feed the toner in the longitudinal direction of the container. More particularly, the inclined portion is effective to feed the toner existing adjacent the end of the container toward the toner discharge opening 1*b* which is disposed in the longitudinally central portion. The stirring blades are made of a polyester sheet.

The structures and materials of the feeding member 4 is not limited to the above-described structure, but may be any if the toner can be stirred and fed by rotation thereof. For example, the material and/or the configuration of the stirring blades may be modified, or a different feeding mechanism is usable.

(Shutter of Toner Supply Container)

As shown in FIG. 3 at (a), the container shutter 3 for opening and closing the toner discharge opening 1*b* has a curvature so that it extends along the outer surface of the toner supply container 1. The container shutter 3 is engaged with two guide portions 1*d* provided at the opposite longitudinal ends of the toner discharge opening 1*b*. The guide portions 1*d* function to guide a slide movement of the container shutter along the outer surface of the container when the toner discharge opening 1*a* is to be opened and closed. The guide portion 1*d* is provided with a stopper portion 1*d*' for determining the closing position of the container shutter 3.

The container shutter has a leading end portion with respect to an unsealing rotational direction, and the leading end portion abuts a stopper portion provided in the toner receiving apparatus upon the setting operation of the toner supply container, thus preventing a further integral rotation of the toner supply container and the container shutter. After abutting the stopper, the toner supply container rotates relative to the container shutter which is stopped to open the toner discharge opening, thus unsealing the toner supply container.

Furthermore, upon the dismounting operation of the toner supply container which will be described hereinafter, a leading end portion of the container shutter with respect to a closing direction abuts a stopper portion of the toner receiving apparatus, by which a further integral rotation of the toner supply container and the container shutter is prevented. Therefore, by rotation of the toner supply container relative to the container shutter which is stopped, the toner discharge opening moves back to the position where it is closed by the container shutter. Thus, the toner discharge opening is resealed.

In order to prevent the leakage of the toner, it is preferable to provide a sealing member on a surface of the container shutter 3 opposed to the toner discharge opening 1*b*, or the neighborhood of the edges of the toner discharge opening 1*b* of the container body 1*a* may be provided with a sealing member. These sealing members may be provided on the container shutter 3 and the container body 1*a*, respectively. Such a sealing member is compressed by a predetermined degree between the container shutter and the outer surface of the container body.

In this embodiment, use is made with structure employing the container shutter 3 capable of closing and opening the toner discharge opening 1*b*. The container shutter 3 is not inevitable, and in an alternative structure, a sealing film of resin material may be welded, for example, on the container body portion around the edge of the toner discharge opening to hermetically seal the opening, and upon the toner supply, the sealing film is peeled off.

With such an alternative structure, the toner discharge opening 1*b* cannot be resealed when the container is exchanged after the end of the toner supply, and therefore, there is a liability that toner scattering may occur. For this reason, the provision of the container shutter 3 as in this embodiment is desirable, and then the toner discharge opening can be resealed.

In the case that, there is a possibility that toner leaks out during transportation before the toner supply operation depending on the configuration of the discharge opening of the container and/or on the amount contained in the container, both of the sealing film and the container shutter may be used to further assure the sealing performance. In such a case, it is desirable that part of the sealing film is stuck on the container shutter, and the sealing film is removed with the unsealing movement of the container shutter.

(Developing Device Shutter Interrelating Mechanism of Toner Supply Container)

On the peripheral surface of the container body 1*a*, there are provided an opening projection 1*e* (interrelating portion (engaging portion)) and a sealing projection 1*f* (interrelating portion (engaging portion)) to open and close a developing device shutter 11 (FIG. 5) with the rotating operation of the toner supply container.

More particularly, upon the setting operation of the toner supply container 1 which will be described hereinafter, the opening projection 1*e* lowers the developing device shutter 11 to unseal or open the toner receiving opening 10*b* (FIG. 5). Upon the dismounting operation of the toner supply container which will be described hereinafter, the sealing projection 1*f* raises the developing device shutter 11 to reseal or close the toner receiving opening 10*b*. The portions of the developing device shutter 11 against which the opening projection 1*e* and the sealing projection 1*f* abut function to interrelate the rotation of the toner supply container with the opening and closing moving operation of the developing device shutter.

The opening projection 1*e* is disposed at a relatively upstream side with respect to an unsealing moving direction of the developing device shutter 11 when the toner supply container 1 is mounted to the toner receiving apparatus 10 (FIG. 5), and the sealing projection 1*f* is disposed at a relatively downstream side.

(Drive Transmitting Means of Toner Supply Container)

Referring to FIG. 3, the description will be made as to a structure of drive transmitting means of the toner supply container for a driving connection with a driving gear 12 (driving member, FIG. 5) provided in the toner receiving apparatus 10 and for transmitting the rotational driving force from the driving gear 12 to the feeding member 4.

In this embodiment, the drive transmitting means comprises a gear train including juxtaposed gears, and the rotation shafts of the gears are rotatably supported directly on the end surface of the toner supply container.

Figure 10:
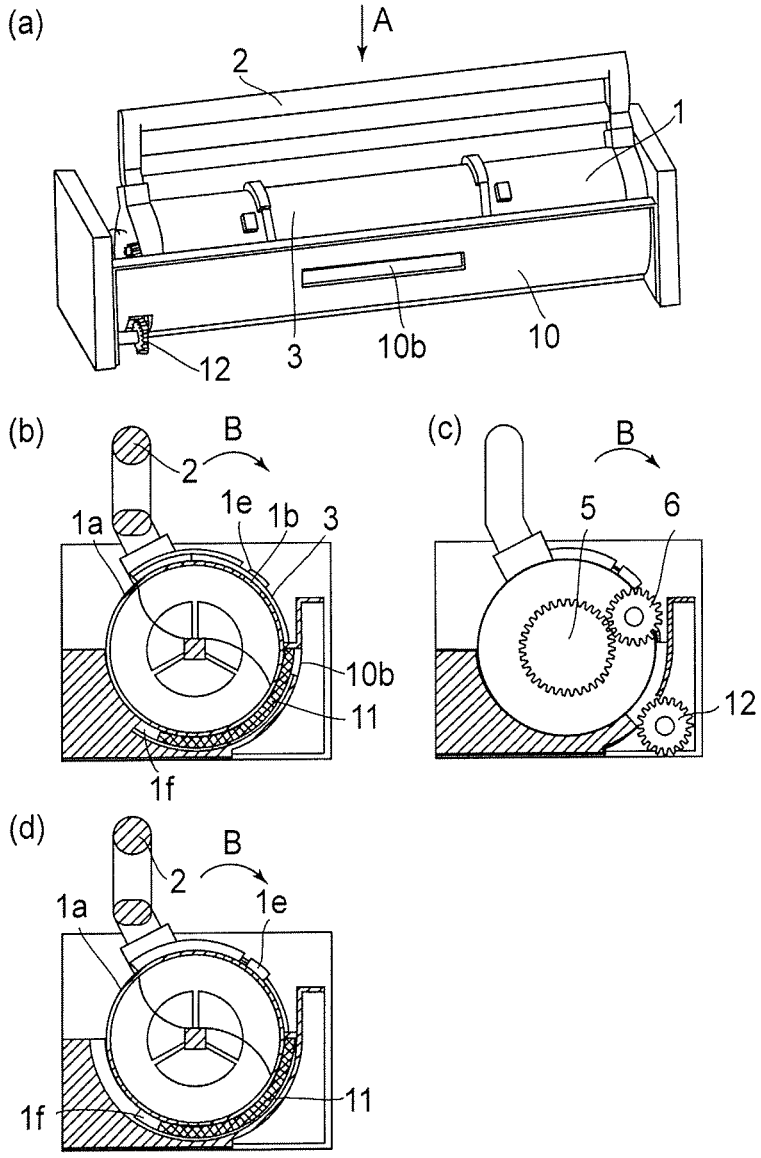
FIG. 10 illustrates a toner supply container when it is at a mounting position, wherein (a) is a perspective view thereof, (b)-(d) are sectional side views thereof.

When the toner supply container 1 is mounted into the toner receiving apparatus 10 by the user operation (mount position) ((C) of FIG. 10), the drive transmitting means is at a position away, in the circumferential direction, from the driving gear 12, and therefore, is not in driving connection with the driving gear 12, more particularly, not engaged therewith. The toner supply container at the mount position can be removed form the toner receiving apparatus.

With such a structure, the abutment between the driving gear 12 and the drive transmitting means of the toner supply container (second gear 6 which will be described hereinafter) can be avoided upon the mounting of the toner supply container, and therefore, the deterioration or damage due to the abutment can be avoided.

Figure 11:
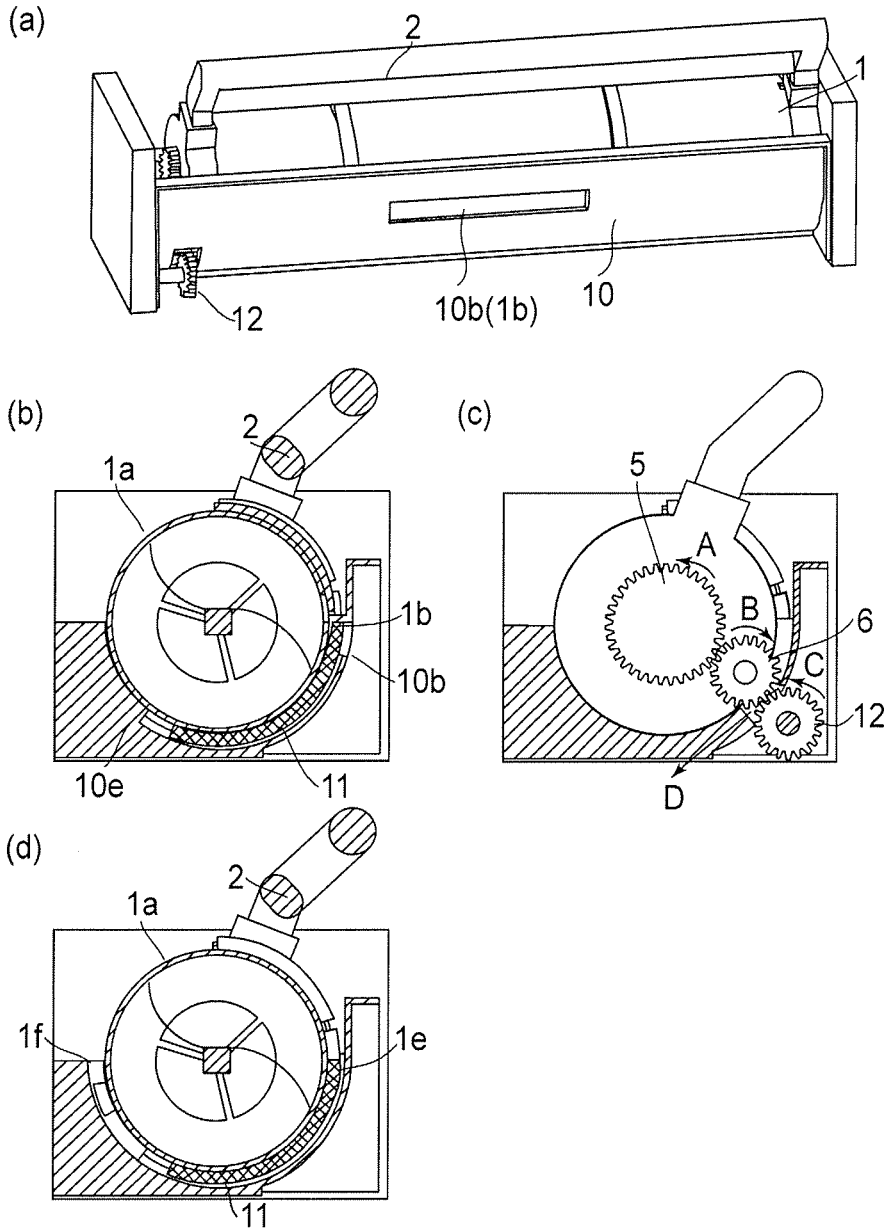
FIG. 11 illustrates the toner supply container when it is at a set position thereof, wherein (a) is a perspective view, and (b)-(d) are sectional side views thereof.

Then, the toner supply container 1 is manually rotated through a predetermined angle to a set position ((C) in FIG. 11) from the mount position. At the set position, the drive transmitting means and the driving gear 12 are in driving connection or engagement with each other (engagement state).

As will be described hereinafter, the toner supply container is automatically rotated from the set position to a supplying position where the toner supply is enabled, using the drive transmitting means.

The drive transmitting means of this example is constituted by the first gear 5 and the second gear 6 disposed on one longitudinal end surface of the container body 1*a*.

As shown in FIG. 3, the rotation shaft of the first gear 5 (reversing member) is rotatably supported on the end surface of the container body and is in co-axial engagement with the feeding member 4. The center of rotation of the first gear 5 substantially aligned with the rotational center of the toner supply container about which the toner supply container is rotated through a predetermined angle by the handle 2 driven by the user during the setting operation from the mount position toward the set position.

As shown in FIG. 3, the second gear 6 (drive transmission member, driving force receiving member) has a rotation shaft which is rotatably supported on the end surface of the container body at a position away from the rotational center of the toner supply container 1 (eccentric position), and is in meshing engagement with the first gear 5. Thus, the center of rotation of the second gear 6 is eccentric from the center of rotation of the toner supply container.

The first gear 5 and the second gear 6 are sufficient if they can sufficiently transmit the driving force from the toner receiving apparatus 10, and in this embodiment, they are gears made of polyacetal resin material through injection molding. In this embodiment, the first gear 5 has a diameter of 40 mm, and the number of teeth thereof is 40; the second gear has a diameter of 20 mm, and the number of teeth is 20. The driving gear 12 has a diameter of 17 mm, and the number of teeth is 17. The diameters, the modules, the numbers of teeth of the gears are selected so that drive transmission is properly accomplished, and these values are not inevitable.

Around that shaft portion of the container body 1*a* which is rotatably supported on the container body 1*a*, an oil seal (sealing member) is mounted to prevent toner leakage from the inside of the container body 1*a*. On the other hand, since the second gear 6 is rotatably supported in the outer casing member of the container body 1*a*, no such oil seal is provided.

Since the second gear 6 is supported at a position away from the rotational center of the toner supply container 1, it is away from the driving gear 12 in the circumferential direction when the toner supply container 1 is at the mount position.

The second gear 6 is brought into meshing engagement with the driving gear 12 provided in the toner receiving apparatus 10 by the rotation of the toner supply container. In other words, when the toner supply container 1 is rotated to the set position by the user operation, the meshing engagement or the driving connection between the second gear 6 and the driving gear 12 begins ((c) in FIG. 11).

In this example, this is accomplished by the determined position of the second gear 6 on the container body 1*a* in the rotational direction.

Then, when the toner supply container is at the supplying position, the second gear 6 receives a rotating force from the driving gear 12, by which the first gear 5 which is in a driving connecting relation with the second gear 6, rotates. As a result, the feeding member 4 rotates relative to the container body 1*a* which is substantially non-rotatably set in the toner receiving apparatus, thus discharging the toner. During the toner supply operation, the second gear 6 rotates in the rotational direction B (FIG. 12) which is the same direction as the rotational direction of the toner supply container 1 during the setting operation, by the driving gear 12 which rotates in the direction C in FIG. 12.

In this example, the container has a substantially cylindrical configuration, the center of rotation of the feeding member is substantially the same as the center of rotation of the container body, and therefore, the center of rotation of the first gear 5 directly connected with the feeding member 4 is also substantially the same as the center of rotation of the container body 1*a*. The second gear 6 has a center of rotation which is different from that of the first gear 5, and with the rotation of the toner supply container 1, to circulate or revolve about the center of rotation of the container body 1*a*, so that it is brought into engagement with the driving gear portion 12 of the toner receiving apparatus 10.

In this manner, the second gear 6 is rotated relative to the toner supply container by the driving force received from the driving gear 12 in the toner supply step, that is, it rotates about its rotational axis, in this embodiment. In addition, the second gear 6, in the setting step of the toner supply container, is rotated together with the toner supply container about the rotational axis of the toner supply container by the driving force received from the driving gear 12.

The center of rotation of the feeding member may be made different from the center of rotation of the container. For example, the center of rotation of the feeding member may be shifted toward the toner discharge opening shifting. In such a case, the first gear 5 is supported at a position different from the center of rotation of the container body, correspondingly to the center of rotation of the feeding member, and similarly to the foregoing example, with the rotation of the container, the second gear 6 circulates or revolves about the center of rotation of the container body 1*a* to be brought into engagement with the driving gear 12 of the toner receiving apparatus 10.

When the center of rotation of the feeding member is different from the center of rotation of the container body, the first gear 5 may be omitted, that is, the drive transmitting means is constituted by the second gear 6. More particularly, the second gear 6 is provided co-axially with the feeding member 4, and shaft portion of the second gear 6 and the shaft portion of the feeding member 4 are connected to each other. In the case of such a structure, the rotational direction of the feeding member 4 is opposite from that in the foregoing example, the toner is fed from the upper part to the lower part toward the toner discharge opening which is laterally oriented, more particularly, in the direction of about 3 o'clock in the Figure. That is, the toner discharging performance deteriorates.

Then, the feeding member in this case preferably has the following structure. The feeding member comprises a resin material plate having a high hardness effective to raise the toner in the container by the rotation thereof, and a plurality of guide projections on each of the sides of the resin material plate, the guide projections being effective to guide the raised toner toward the lower toner discharge opening. With such a structure, a rotation shaft is provided at each of the opposite longitudinal ends of the resin material plate, and one end of the rotation shaft is directly or indirectly connected with the second gear 6.

In the case of such a feeding member constituted by the resin material plate, the remaining toner amount in the container (the amount of the toner remaining at the end of life of the toner container). From such a standpoint, the structure using the first gear 5 and the second gear 6 as in this embodiment is preferred.

In other words, as will be described hereinafter, the rotational direction of the feeding member is opposite from the direction B in FIG. 10 in consideration of the toner feeding and discharging performance.

On the other hand, as will be described hereinafter, in order to accomplish the automatic rotation of the toner supply container using the drive transmitting means of the toner supply container, it is desirable that rotational direction of the second gear 6 is B in FIG. 10, and the rotational direction of the driving gear 12 is opposite the direction B.

In this embodiment, in order to satisfy the dual function (toner feeding and discharging performance and the automatic rotation of the toner supply container), the drive transmitting means is constituted by the first gear 5 and the second gear 6 (two gears). In other words, the first gear 5 functions as a rotational direction converting mechanism for converting the rotating force provided by the second gear 6 to the rotating force in the rotational direction of the feeding member.

The rotational direction converting mechanism (reversing mechanism) is not limited to the first gear 5, but may be as follows. In place of the first gear 5, the use is made with a combination of a drive transmission belt and a pulley (supporting member) which rotates co-axially with the feeding member (the center of rotation thereof is aligned with the center of rotation of the toner supply container). The pulley is directly or indirectly connected with the feeding member. The rotation shaft of the second gear 6 is extended in the longitudinal direction of the container (frontwardly of the sheet of the drawing of FIG. 10, (c), and between the portion of the extended rotation shaft and the pulley, the drive transmission belt is trained around them in the form of "8"

Figure 6:
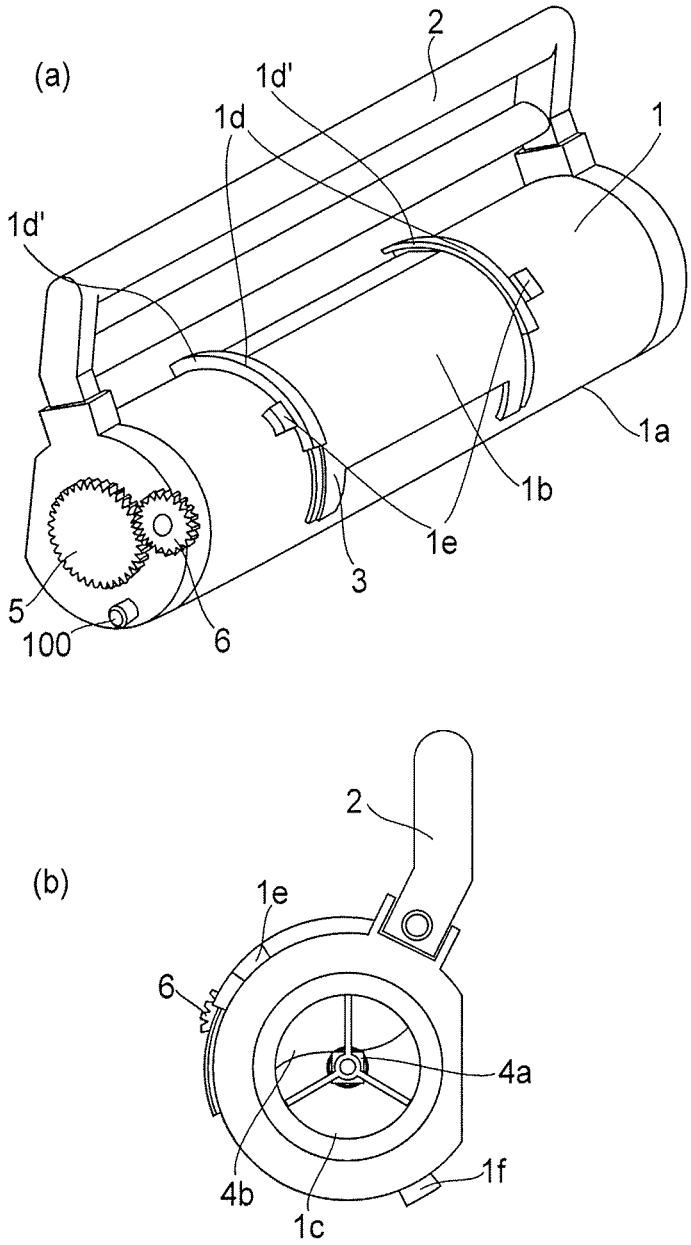
FIG. 6 illustrates a toner supply container having a non-cylindrical shape, wherein (a) is a perspective view thereof, and (b) is a sectional view thereof.

In this example, the configuration of the container is cylindrical, and the configuration of the container is not limited to such a configuration. For example, in order to prevent rolling of the toner supply container when it is placed on the desk or floor, the toner supply container may have a cross-section in a "D" shape as shown in FIG. 6. In such a case, the center of rotation of the toner supply container is the center of the arcuation adjacent the toner discharge opening is substantially the rotational center of the shutters. By doing so, the shutters and so on can be moved with high accuracy when the container is rotated.

(Rotation Resistance Applying Means)

Figure 7:
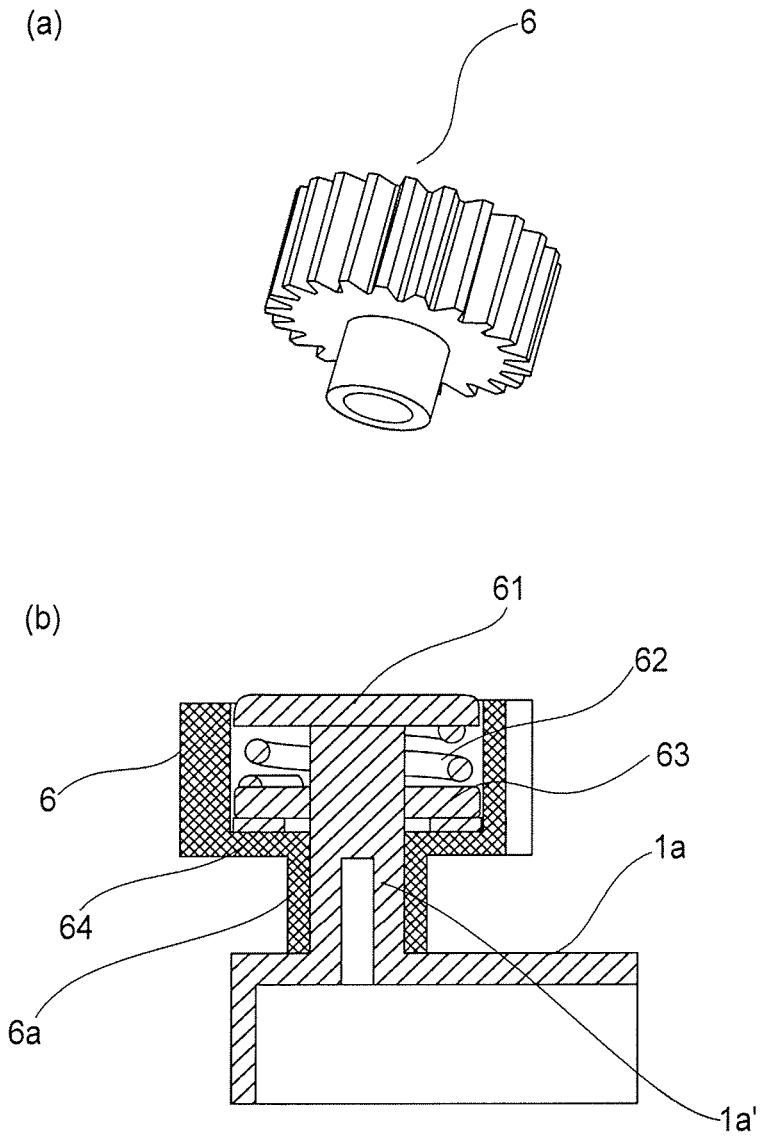
FIG. 7 illustrates a second gear 6, wherein, (a) is a perspective view thereof, and (b) is a sectional view of a supporting structure therefor.

As shown in FIG. 7, the shaft portion 6*a* of the second gear 6 is engaged with a projected portion 1*a*' provided on the end surface of the container body 1*a*. The second gear 6 is in the form of a cup in which a ring member 64 (sliding member, elastic member) of silicone rubber as a rotation resistance applying means is provided and is compressed to a predetermined degree. In more detail, the ring member 64 of silicone rubber is compressed between a pressing member 63 and the bottom surface of the cup of the second gear 6 by a spring (urging member). The pressing member 63 is fixed on the projected portion 1*a*'. A cap-like member 61 (urging member) is fixed to the projected portion 1*a*' so that spring 62 is compressed between the pressing member 63 and the cap-like member 61.

In this manner, in this embodiment, the second gear 6 is in surface contact with the ring member 64, so that second gear 6 is not easily rotated relative to the container body 1*a*. In other words, the rotation resistance of the second gear 6 relative to the container body 1*a* is set to be sufficiently large.

On the other hand, the first gear 5 is not provided with such a rotation resistance applying means, and therefore, when only the first gear 5 is taken, the rotation resistance relative to the container body 1*a* is sufficiently small.

The first gear 5 and the second gear 6 function to transmit the rotating force to the feeding member, and therefore, are not easily rotated relative to the container body 1*a* due to the provision of the rotation resistance applying means. This is used to accomplish the automatic rotation of the toner supply container which will be described hereinafter.

The rotation resistance applying means is not limited to the above-described structure, but may be any known one. For example, a urethane rubber is usable in place of the silicone rubber. In place of the silicone rubber, and elastomer resin material is usable. Alternatively, the rotation resistance applying means may be the stirring blade which is rigid and long enough to provide sufficient sliding resistance relative to the inner surface of the container against the rotation. Further alternatively, a sealing property of a sealing member such as an oil seal, provided for the first gear 5, for preventing toner leakage may be enhanced to function as the rotation resistance applying means, too.

The position where the rotation resistance applying means is provided may be other than the second gear 6. The rotation resistance applying means may be provided to the first gear 5 or the like, if the drive transmitting means is effective to retard or impede the rotation thereof relative to the toner supply container. For example, the rotation resistance applying means may be provided to the portion (bearing) of the container for rotatably supporting the filling port side end of the stirring shaft 4*a*.

The specific structure or position of the rotation resistance applying means are not limited to the examples described in the foregoing, if the automatic rotation of the toner supply container which will be described hereinafter is accomplished.

If the rotation resistance applied to the first gear 5 and the second gear 6 by the rotation resistance applying means is too large, the torque required for the driving motor to feed and discharge the toner through the feeding member is too large. In this embodiment, this is taken into account, and the rotation resistance applied to the first gear 5 and the second gear 6 by the rotation resistance applying means is determined so as to accomplish the automatic rotation of the toner supply container.

(Assembling Method of Toner Supply Container).

The toner supply container 1 is assembled through the following steps.

First, the container body 1*a* is prepared. Then, the feeding member 4 is fixed in the container body 1*a*. Thereafter, the first gear 5 is mounted to one end surface of the container body 1*a*, and then the second gear 6 is mounted. Furthermore, a container shutter 3 and the handle 2 are assembled on the container body.

Then, the toner is filled through the filling port 1*c*, and finally, the filling port is sealed by a sealing member.

The order of the toner filling, the mounting of the second gear 6, the assembly of the container shutter 3 and the handle 2 may be changed for the convenience of the assemblying.

In this embodiment, the container body 1*a* is a cylindrical container having an outer diameter of 60 mm and a length of 320 mm. The inner volume of the container is approx. 600 cc in which 300 g of the toner is filled.

(Toner Receiving Apparatus)

Referring to FIG. 5, the toner receiving apparatus 10 will be described. The toner receiving apparatus 10 comprising a mounting portion 10*a* for demountably mounting the toner supply container 1, and a toner receiving opening 10*b* for receiving the toner discharged from the toner supply container 1. The toner supplied from the toner receiving opening is supplied into the developing device and is used for image formation.

The toner receiving apparatus 10 is further provided with a developing device shutter 11 having a substantially semi-cylindrical surface in a nesting relation with the peripheral surface configuration of the mounting portion 10*a* and with the toner supply container 1. The developing device shutter is engaged with a guide portion 10*c* provided at the lower edge of the mounting portion 10*a* to make sliding motion along the circumference to open and close the toner receiving opening 10*b*.

Furthermore, the toner receiving apparatus 10 is provided with a stopper 10*e* (FIG. 11, (a)) for stopping, at an end position, the opening movement of the developing device shutter 11. By doing so, when the developing device shutter 11 is opened, the lower end of the toner receiving opening 10*b* and the upper end of the developing device shutter 11 are aligned with high accuracy to completely open the toner receiving opening 10. The stopper 10*e* functions also as a stop portion for stopping rotation of the container body 1*a* at the position where the toner discharge opening 1*b* is opposed to the toner receiving opening 10*b*. In other words, the rotation of the toner supply container 1 engaged with the developing device shutter 11 through the opening projection (interrelating portion) is stopped with the stop of the unsealing movement of the developing device shutter 11 by the stopper 10*e*.

(Locking Mechanism for Developing Device Shutter)

Figure 8:
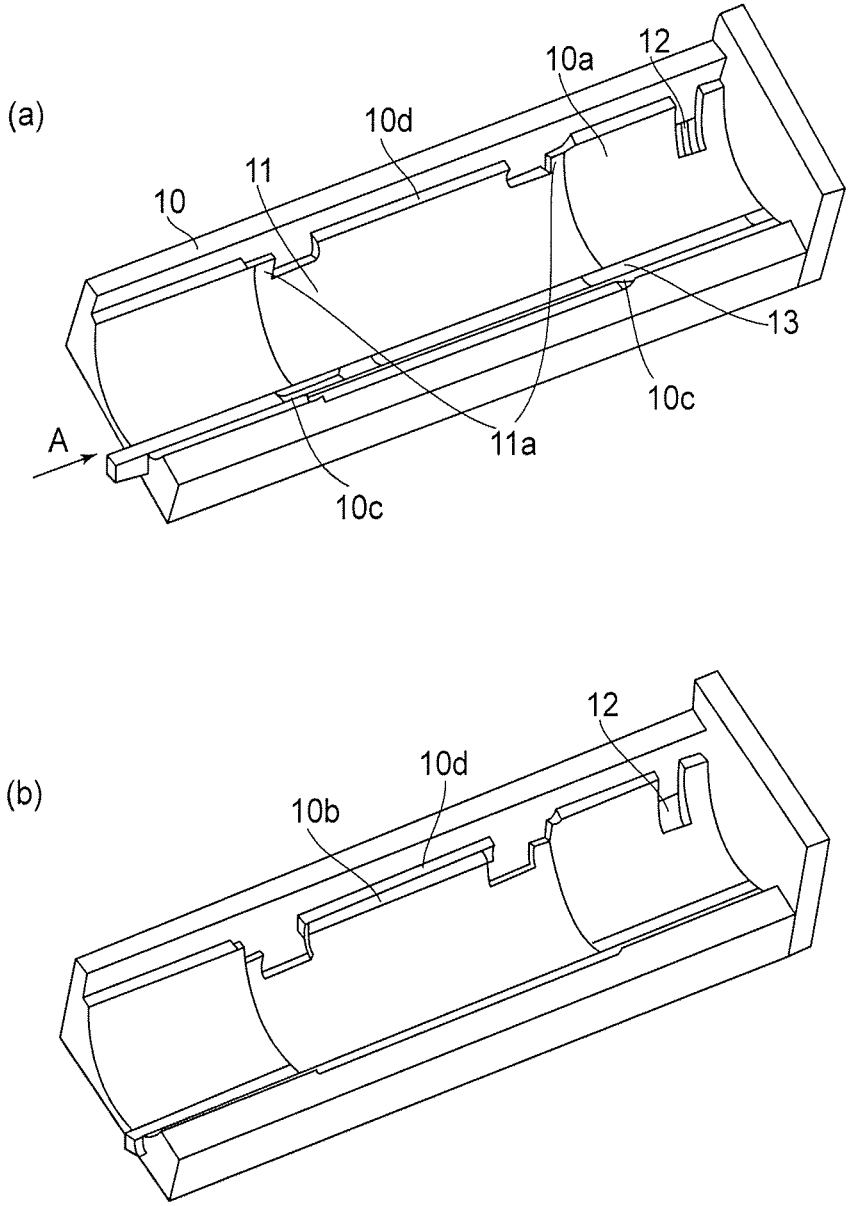
FIG. 8 illustrates a locking structure for a developing device shutter, wherein (a) is a perspective view thereof in a locking state, and (b) is a perspective view thereof in a release state.

The developing device shutter 11, as shown in FIG. 8, (a), when the toner supply container 1 is not mounted to the mounting portion 10*a*, is locked at the position to seal the toner receiving opening 10*b*. More particularly, one end of the developing device shutter 11 is abutted to the stopper 10*d* of the toner receiving apparatus 10, and the other end is abutted to the locking member 13 (locking means), so that movement thereof is blocked at the position sealing the toner receiving opening 10*b*.

By doing so, the possible introduction of dust or foreign matter into the developing device 201 and the possible leakage of the toner from the developing device 201 to the mounting portion 10*a* are effectively prevented.

Figure 9:
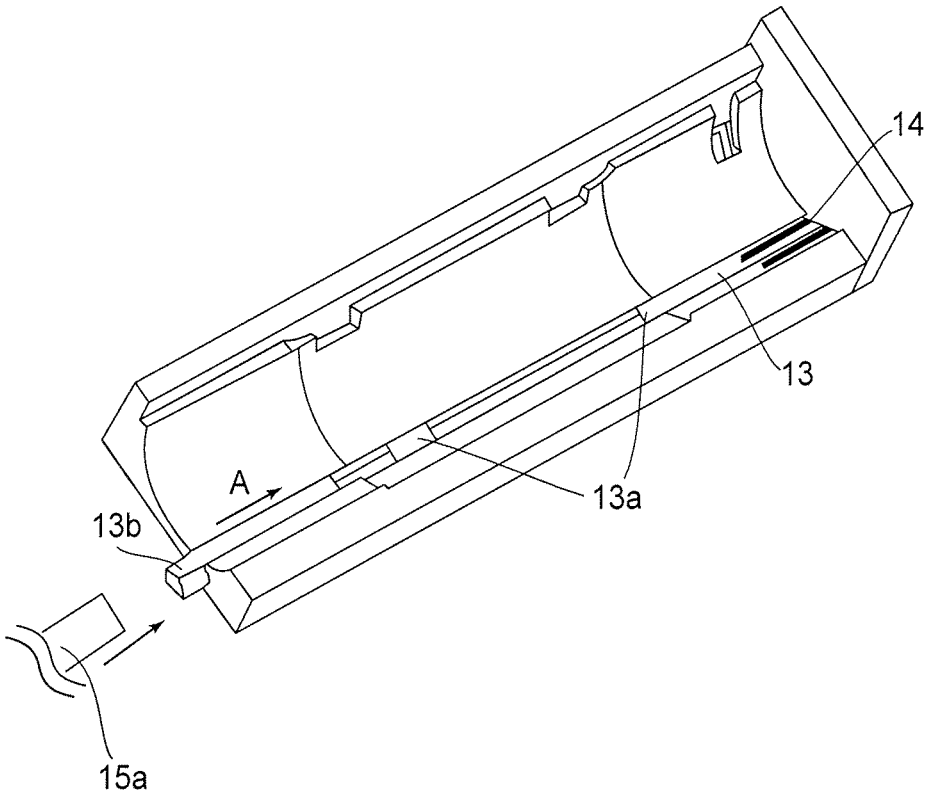
FIG. 9 is a perspective view illustrating a relation between the locking member for the developing device shutter and an exchange cover.

The locking member 13, as shown in FIG. 9, is abutted to a part of the developing device shutter 11 at the locking portion 13*a*, so that movement of the developing device shutter 11 in the unsealing direction is prevented. In addition, the locking member 13 is slidable in the direction A (FIG. 9).

In this embodiment, the developing device shutter 11 is released only when the exchange cover 15 is closed.

More particularly, with the closing operation of the exchange cover 15 by the user, a release member 15*a* (releasing means) provided on the exchange cover 15 is brought into engagement with a receiving portion 13*b* of the locking member 13 to slide the locking member 13 in the longitudinal direction (arrow A in FIG. 8). Then, the locking portion 13*a* moves to a release position where it does not interfere with the developing device shutter 11 to permit the movement, in the unsealing direction, of the developing device shutter 11.

As shown in FIG. 9, a spring member 14 (urging member) is provided at a rear side with respect to the longitudinal direction of the locking member 13. The locking member 13 is normally urged by the spring member 14 toward the front side in the longitudinal direction (opposite to the direction A in FIG. 9). In other words, the locking member is urged so as to restore to the locking position with retraction of the release member 15*a*.

(Driving Gear of Toner Receiving Apparatus)

As shown in FIG. 5, at one longitudinal end of the mounting portion 10*a*, there is provided a driving gear 12 (driving member) for transmitting a rotational driving force from a driving motor disposed in the main assembly of the image forming apparatus 100. The driving gear 12 is stationary in the toner receiving apparatus, that is, is not movable even if the driving gear 12 is interfered with the end of a tooth of the second gear 6 of the toner supply container, and therefore, they are not brought into meshing engagement with each other, as contrasted to a well-known structure wherein the driving gear 12 is retractable by abutment by the second gear 6.

The driving gear 12, as will be described hereinafter, functions to apply the rotating force to the toner supply container to rotate the toner supply container during the setting operation. Namely, the rotational direction of the driving gear 12 by the driving motor is as indicated by C in FIG. 12 (opposite to the rotational direction of the toner supply container during the setting operation). In this example, the driving gear 12 is operatively engaged with a driving gear train for rotating the photosensitive drum 104, the developing roller 201*b*, the feeding member 201*c* of the developing device shown in FIG. 2.

(Setting Operation of Toner Supply Container)

Figure 12:
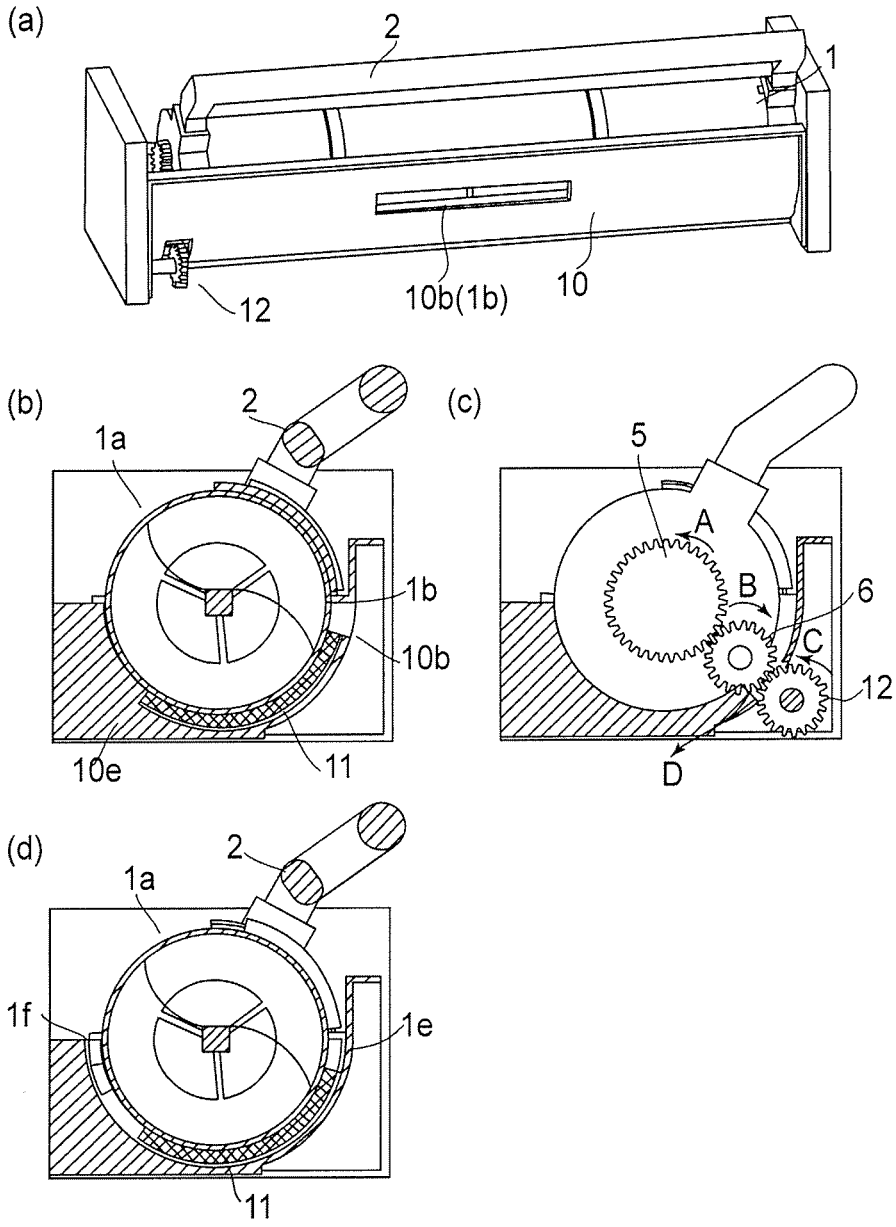
FIG. 12 illustrates the toner supply container when it is at a supplying position, wherein (a) is a perspective view thereof, and (b)-(d) are sectional side views.

Referring to FIG. 10 to FIG. 12, the setting operation of the toner supply container will be described.

FIG. 10 illustrates a state in which the toner supply container is mounted, and FIG. 11 illustrates a state in which it is rotated to the set position. FIG. 12 shows a state in which the toner supply container is rotated to the supplying position.

In FIG. 10 to FIG. 12, (a) are schematic views of the toner supply container and the toner receiving apparatus. In these Figures, (b) are sectional views illustrating a relation among the toner discharge opening 1*b*, the toner receiving opening 10*b* and the developing device shutter 11. In these Figures, (c) are sectional view illustrating relations among the driving force transmitting means. In these Figures, (d) are sectional views illustrating the relation between the developing device shutter 11 and the interrelating portion of the container body.

The setting operation of the toner supply container comprises a manual step which is carried out by the user and an automatic step which is carried out by the toner receiving apparatus.

The manual step includes a mounting operation in which the user mounts the toner supply container to the mount position of the toner receiving apparatus (the position where the mounting and demounting of the toner supply container are permitted), and a rotation in which the user rotates the toner supply container from the mount position to the set position (the position where the second gear 6 is in meshing engagement with the driving gear 12). At the set position, the opening projection of the toner supply container is engaged with the developing device shutter. When the user rotates the container through a predetermined angle (approx. 2-3°), the interrelating portion (opening projection) is stopped by the toner receiving apparatus, by which the toner supply container is prevented from being removed. Therefore, when the toner supply container is at the set position or supplying position, the dismounting of the toner supply container is prohibited.

The rotation of the toner supply container from the set position to the supplying position (the position where the toner supply is possible) is the automatic step. These rotations of the toner supply container are all in the same direction (arrow B in FIG. 10). When the toner supply container is at the supplying position, too, the toner supply container is prevented from being dismounted.

The angle of rotation of the toner supply container between the mount position and the set position is approx. 60°, and the angle of rotation thereof between the set position and the supplying position is approx. 12°.

(Mounting Step for Setting Operation)

First, the user opens the exchange cover 15, and inserts the toner supply container 1 into the toner receiving apparatus 10 in the direction of the arrow A in FIG. 10, (a) (the direction substantially perpendicular to the longitudinal direction of the toner supply container).

At this time, the mounting attitude of the toner supply container 1 in the rotational direction is regulated. More particularly, the user inserts the toner supply container 1 into the toner receiving apparatus while aligning the regulated projection 100 (FIG. 3) of the toner supply container with the regulation recess 10*f* (FIG. 5) of the toner receiving apparatus. As a result, the toner supply container is mounted with the toner discharge opening thereof faces up (the direction of 12 o'clock). By doing so, when the toner supply container is taken out of the toner receiving apparatus, as will be described hereinafter, the toner remaining in the toner supply container does not leak between the peripheral surface of the container body and the container shutter.

The orientation of the toner discharge opening during this mounting operation by the user is not limited to the strict upward, but may be generally upward. More particularly, the orientation of the toner discharge opening is preferably within a range of ±30° from the vertical line (between 11 o'clock direction and 1 o'clock direction). The direction of the toner discharge opening is the direction of a line connecting the center of the toner discharge opening in the rotational direction of the toner supply container and the center of rotation of the toner supply container. The angle formed between such a line and the vertical line is preferably in the range of ±30°. As shown in FIG. 10, (c), the driving gear 12 in the toner receiving apparatus 10 side and the second gear 6 in the toner supply container 1 side are out of engagement from each other, and more particularly, they are away from each other in the rotational direction of the container 1.

(Manual Rotation Step for Setting Operation)

Then, the user manipulates the handle 2 to rotate the toner supply container 1 placed at the mount position in—the toner receiving apparatus 10 in—the direction B as shown in FIG. 10, that is, the direction opposite the rotational direction of the feeding member 4. Then, with the rotation of the toner supply container 1, the second gear 6 revolves about the center of rotation of the toner supply container 1 (the center of rotation of the feeding member 4) toward the driving gear 12 of the toner receiving apparatus 10. Then, when the toner supply container 1 is rotated to the set position, the toner supply container is prevented from further rotation, and therefore, stops (FIG. 11). More particularly, the opening projection 1*e* of the toner supply container abuts against the developing device shutter 11 which is prevented from movement by the locking member 13, and therefore, the rotation of the toner supply container is prevented. In this manner, the opening projection 1*e* functions to stop the manual rotation of the toner supply container.

With the rotation of the toner supply container from the mount position to the set position, the second gear 6 is brought into engagement with the driving gear 12 of the toner receiving apparatus. Thereafter, the drive transmission from the driving gear 12 to the second gear 6 is enabled.

On the other hand, the toner discharge opening and the toner receiving opening have not yet been unsealed when the toner supply container is at the set position. That is, the toner discharge opening and the toner receiving opening are closed by the container shutter and the developing device shutter.

(Automatic Rotation Step of Setting Operation)

With the toner supply container set at the set position, the user closes the exchange cover 15. In interrelation therewith, the developing device shutter 11 is released from the locking member 13. In interrelation with the closing operation of the exchange cover 15, the driving gear 12 starts to rotate by the driving motor.

With the rotation of the driving gear 12, the toner supply container receives a rotational force (pulling force) in the direction D by the second gear 6 engaged with the driving gear 12, so that toner supply container is automatically rotated from the set position to the supplying position. The mechanical principle of the automatic rotation of the toner supply container will be described hereinafter.

When the toner supply container 1 reaches the supplying position, further rotation of the toner supply container is prevented. This is because the developing device shutter 11 abuts the stopper 10*e* (FIG. 12, (b)) for defining the end position of the unsealing movement of the developing device shutter 11. The further rotation of the toner supply container is prevented through the opening projection 1*e* abutting against the developing device shutter 11. Namely, the opening projection 1*e* functions also to stop the automatic rotation of the toner supply container.

In interrelation with the rotation of the toner supply container from the set position to the supplying position, the toner discharge opening and the toner receiving opening is unsealed, and the toner discharge opening and the toner receiving opening are completely aligned with each other. That is, at a time when the toner supply container reaches the supplying position, the toner supply from the toner supply container to the toner receiving apparatus is enabled.

More specifically, in interrelation with the rotation of the toner supply container from the set position to the supplying position, the container shutter 3 abuts the stopper portion of the toner receiving apparatus 10, so that further rotation is prevented, and the toner supply container is gradually opened. When the toner supply container is rotated to the supplying position, the toner discharge opening 1*b* is completely opened.

On the other hand, in interrelation with the rotation of the toner supply container from the set position to the supplying position (opening or unsealing operation of the container shutter), the developing device shutter 11 is lowered to the opening projection 1*e* of the toner supply container 1 so that toner receiving opening 10*b* gradually opens. Since the developing device shutter 11 is stopped by the stopper 10*e* which determines the end position of the opening movement thereof (FIG. 12, (b)), the lower end of the toner receiving opening 10*b* and the upper end of the developing device shutter 11 are aligned correctly. Thus, when the toner supply container rotates to the supplying position, the toner receiving opening 10*b* is completely opened.

As a result, when the toner supply container is rotated to the supplying position, both of the toner discharge opening and the toner receiving opening are opened while they are aligned with each other.

Thereafter, when the driving gear 12 is rotated, the rotating force is transmitted from the second gear 6 to the feeding member 4 through the first gear 5, and the toner supply is carried out from the toner supply container to the toner receiving apparatus.

In this embodiment, the positions, in the circumferential direction, of the toner discharge opening 1*b*, the opening projection 1*e*, the second gear 6 and so on relative to the toner supply container 1 are adjusted so that above-described operations are carried out at the correct timing in proper interrelations.

In this manner, this embodiment accomplishes the automatic rotation of the toner supply container to the supplying position which is important in carrying out the toner supply step, that is, to the final rotational position of the toner supply container, without using another driving system for such a rotation. As a result, the usability is improved with a simple structure of the toner supply container.

Namely, the second gear 6 for the feeding member driving is utilized for the automatic rotation of the toner supply container to determine and assure the final position, in the rotational direction, of the toner supply container, the final position being one of the important factors in the subsequent toner supply step. According to the above-described structure utilizing the second gear 6 which is for driving the toner feeding member, for the automatic rotation of the toner supply container, the deterioration, damage or the like of the second gear 6 due to the teeth abutment with the driving gear 12 upon mounting of the toner supply container can be avoided.

The same applies to the driving gear 12 of the toner receiving apparatus in that deterioration, damage or the like of the driving gear 12 due to the teeth abutment can be avoided. In other words, using the structure of the toner supply container of this embodiment, the contribution to the suppression of the deterioration, damage or the like of the driving gear 12 of the toner receiving apparatus is accomplished.

Therefore, the subsequent toner supply operation is smoothly carried out, and the occurrence of image defects such as non-uniform image density, insufficient image density and so on can be avoided.

In addition, according to the embodiment, the driving gear 12 is rotated also in the toner supply step, and therefore, the toner supply container receives a rotational force X (inward pushing force) in the direction B through the second gear 6. In the toner supply step, the toner supply container receives at the inner surface thereof a rotational force in the rotational direction Y opposite the direction B by the sliding friction between the feeding member and the toner supply container, and the inward pushing force B is selected to be sufficiently larger than the rotational force Y.

For this reason, even if the rotation of toner supply container stopped immediately (1-2°) before the supplying position in the automatic rotation step, the positional error (insufficient rotation) could be automatically corrected. More particularly, with start of the toner supply step, the toner supply container is rotated gradually to the correct supplying position. In this manner, the insufficient opening of the developing device shutter 11 can be automatically corrected.

(Principle of Automatic Rotation of Toner Supply Container)

Figure 13:
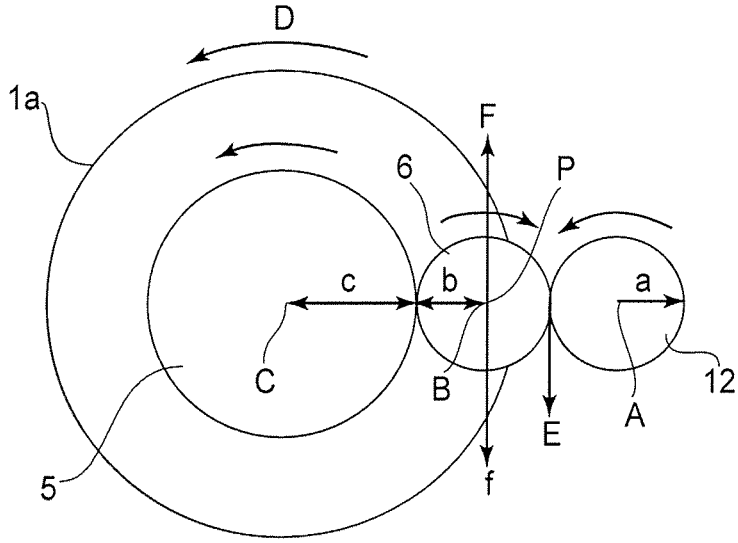
FIG. 13 shows a model illustrating a principle of automatic rotation of the toner supply container.

The principle of the automatic rotation of the toner supply container will be described in detail. FIG. 13 illustrates the principle of the automatic rotation of the toner supply container through the second gear 6 by the rotation of the driving gear 12 which is in meshing engagement with the second gear 6.

In this embodiment, the ring member of silicone rubber is disposed between the second gear 6 and the container body 1*a* and is compressed by a predetermined degree, by which the rotations of the first gear 5 and the second gear 6 relative to the container body 1*a* are retarded or impeded, the first gear 5 and the second gear 6 being for transmitting the rotating force to the feeding member. thus, a load is applied to the second gear 6 against the rotation relative to the container body 6, and the second gear 6 is kept in the loaded condition.

When the driving gear 12 rotates, the rotational force f is applied to the second gear 6, about an axis P thereof, which is in meshing engagement with the driving gear 12. The rotational force f is, therefore, applied to the container body 1*a*. On the other hand, when the toner supply container tends to rotate from the set position to the supplying position, the toner supply container receives an anti-rotational force F from the mounting portion of the toner receiving apparatus, namely, the anti-rotational force by the friction between the toner receiving apparatus and the outer surface of the toner supply container. In this example, since the developing device shutter 11 is slid through an opening projection of the toner supply container, the anti-rotational force F is also provided by the sliding movement resistance of the developing device shutter 11 relative to the toner receiving apparatus.

In this embodiment, the rotational force f applied to the toner supply container by the driving gear 12 is selected be larger than the anti-rotational force F applied to the toner supply container from the toner receiving apparatus.

Therefore, the toner supply container placed at the set position is rotated toward the supplying position with the rotation of the driving gear 12 to the final supplying position.

Thus, in this embodiment, automatic rotation of the toner supply container from the set position to the supplying position is accomplished by the relation (F<f) between the forces f and F. An instantaneous occurrence of F>f in the toner supply container is permissible, if the toner supply container reaches the supplying position finally.

The rotational force f can be measured or determined in this manner. The driving gear 12 in meshing engagement with the second gear 6 is rotated in the direction indicated in FIG. 13, and the rotational torque of the driving gear 12 is measured at this time by an automatic torque measuring device. More particularly, a measurement shaft is co-axially fixed to the rotation shaft of the driving gear 12, and torque converter and the driving motor (stepping motor) are connected in series to the measurement shaft. The electric power supply to the driving motor is controlled so as to maintain the rotational speed of the measurement shaft at 30 rpm. The rotational speed of the measurement shaft is the same as that during the actual automatic rotation step of the toner supply container and the actual toner supply step. When the rotational speed in the actual steps is different, the rotational speed in the measurement is changed correspondingly. In this example, the rotational torque of the driving gear 12 is 0.29N_Em.

The rotational torque of the driving gear 12 corresponds to A which will be described hereinafter, and the rotational force f is determined using a formula which will be described hereinafter. In the case that data obtained from the torque converter periodically varies, a plurality of such data are properly averaged to determine A.

For the measurement, a torque converter (PP-2-KCE) available from Kyowa Dengyo Kabushiki Kaisha was used.

On the other hand, the anti-rotational force F is measured in a similar manner. More particularly, the toner supply container which is in engagement with the developing device shutter is rotated from the set position toward the supplying position. The rotation torque about the rotational center of the toner supply container is measured using the automatic torque measuring device. Even more particularly, the driving gear 12 is removed from the toner receiving apparatus, and a measurement shaft is co-axially fixed to the toner supply container at the rotational center, and the automatic torque measuring device is connected to the measurement shaft similarly to the foregoing measurement. The electric power supply to the driving motor is controlled so as to maintain the rotational speed of the measurement shaft at 6.4 rpm. The rotational frequency or speed of the measurement shaft corresponds to 30 rpm rotation of the driving gear 12 during the automatic rotation step of the toner supply container. When the rotational speed in the automatic rotation step is different from this value, the rotational speed of the measurement shaft is changed correspondingly. In this embodiment, the rotation torque about the rotational center of the toner supply container was 0.58N_Em.

The rotation torque about the rotational center of the toner supply container corresponds to D which will be described hereinafter, and the anti-rotational force F is determined using a formula which will be described hereinafter. In the case that data obtained from the torque converter periodically varies, a plurality of such data are properly averaged to determine D.

Using FIG. 13, the principle will be described in a further detail. Radii of pitch circles of the driving gear 12, the second gear 6 and the first gear 5 are a, b, c, and torques of these gears about the respective axes are A, B, C. The centers of the gears are indicated by A, B and C, too. Here, the rotational force (inward pushing force) applied to the toner supply container by the rotation of the driving gear 12 is E, and the anti-rotation torque of the toner supply container about the rotational center is D.

For the automatic rotation of the toner supply container, f>F is required.

Anti-rotational force: $F=D/(b+c)$ rotational force: $f=\{(c+2b)/(c+b)\}\times E$ $=\{(c+2b)/(c+b)\}\times(A/a)$ $=\{(c+2b)/(c+b)\}\times(C/c+B/b)$ Therefore, $(c+2b)/(c+b)\times(C/c+B/b)>D/(b+c)$ $(C/c+B/b)>D/(c+2b)$ From this, for the automatic rotation of the toner supply container by the inward pushing force, the formula is satisfied. For example, radius C or B or both of them are made larger, and/or D is made smaller.

More particularly, the rotational torque or torques of the first gear 5 which is in direct connection with the feeding member and/or the second gear 6 are made larger, and the anti-rotational force for the toner supply container due to the friction relative to the mounting portion 10*a* of the toner receiving apparatus 10 is made smaller, by which the automatic rotation of the toner supply container is accomplished.

The anti-rotational force of the toner supply container can be adjusted by decreasing the sliding area of the toner supply container relative to the mounting portion 10*a* or by providing the outer surface of the toner supply container with a low sliding resistance member or material. Alternatively, the inner surface of the accommodating portion 10*a* of the toner receiving apparatus may be provided with a roller or rollers (low sliding resistance member or rotation resistance suppression member).

As another effective factor, there is a direction E of the force which the second gear 6 receives the rotating force from the driving gear 12.

rotational force f about the shaft portion P of the second gear 6 is a component force of the force E which the second gear 6 receives from the driving gear 12.

In the model of FIG. 13, a reference line is drawn by connecting the rotational center C of the toner supply container (which is also the center of rotation of the first gear 5 in the shown model) and the center of rotation B of the second gear 6. An angle θ formed between the reference line and a line connecting the point B and the center of rotation An of the driving gear 12 (the angle is positive in the clockwise direction from the reference line (0 degree)) is preferably larger than 90° and smaller than 270°. From the standpoint of efficient utilization of the component (the component force in the direction of a tangent line of the container body at the engagement portion between the second gear 6 and the driving gear 12), in the f direction, of the force E by the engagement between the second gear 6 and the driving gear 12, the angle θ is preferably not less than 120° and not more than 240°. For a further efficient utilization of the component force, the angle θ is about 180° which is the case in this embodiment. The above-described measurement is carried out in the same condition. In this embodiment, the positions and structures of the gears are determined taking the foregoing into consideration.

In the actual structures, there is a loss or the like in the drive transmission between the gears, but they are omitted for the sake of simplicity in the model. The structures of the toner supply containers may be determined in consideration of the loss or the like so as to provide a proper inward pushing force in the automatic rotation of the toner supply container.

As described in the foregoing, during the toner supply operation by rotating the feeding member, the second gear 6 always receives the inward pushing force (opposite from the direction D). During the toner supply operation by rotating the feeding member, the toner supply container also receives a force in a reverse direction (the direction D (FIG. 13)) by the sliding contact between the feeding member 4 and the inner surface of the toner supply container.

In this embodiment, the selection is made so that inward pushing force to the toner supply container is larger than the force in the reverse direction, and therefore, the rotation of the toner supply container from the supplying position toward the set position is prevented during the toner supply step operation.

In this manner, during the toner supply step operation, the toner discharge opening and the toner receiving opening are maintained at respective proper open states.

More particularly, during the toner supply operation, as shown in (c) of FIG. 12, the driving gear 12 rotates in the direction C; the second gear 6 in the direction B; and the first gear 5 in the direction A. At this time, the toner supply container receives a force in the inward direction (E in FIG. 12, (c)), and therefore, the toner discharge opening 1*b* and the toner receiving opening 10*b* are kept alignment with each other so that toner supply is stable.

(Dismounting of Toner Supply Container)

The description will be made as to dismounting of the toner supply container from the toner receiving apparatus for some reason or another.

First, the user opens the exchange cover 15. Then, the user operates the handle 2 to rotate the toner supply container in the direction opposite to the direction of the arrow B in FIG. 10. More particularly, the toner supply container placed at the supplying position is rotated back to the mount position through the set position by the user operation.

At this time, the developing device shutter 11 is closed (raised) by the sealing projection 1*f* of the toner supply container 1, thus closing the toner receiving opening 10*b*. Concurrently, the toner discharge opening 1*b* rotates back to the position where it is closed by the container shutter 3.

More particularly, the container shutter abuts against the stopper portion of the toner receiving apparatus and is at rest there, and from this state, the toner supply container is rotated so that toner discharge opening is closed or resealed by the container shutter. The resealing rotation of the toner supply container is stopped by the stopper portion provided in the guide portion 1*d* of the container shutter 3 abutting the container shutter 3.

With such a rotation of the toner supply container, the second gear 6 revolves to release from the driving gear 12 and becomes non-engageable with the driving gear 12, as shown in FIG. 10, (c).

Then, the toner supply container 1 at the mount position is taken out of the toner receiving apparatus 10 by the user.

This is the end of the dismounting operation of the toner supply container. Thereafter, the user mounts a prepared new toner supply container to the mounting portion of the toner receiving apparatus. The above-described manual rotation step is only up to the set position, and then the exchange cover 15 is closed.

The backward rotation of the toner supply container from the supplying position to the set position can be carried out automatically.

More particularly, when the toner supply container is at the supplying position, the driving gear 12 is rotated in the direction opposite to that in the setting operation, so that opposite force is applied to the toner supply container.

By doing so, the toner supply container is rotated back to the position where the developing device shutter closes the toner receiving opening. At this time, the toner discharge opening is resealed by the container shutter.

In this case, too, the force applied to the toner supply container (in the direction opposite the direction of the inward pushing force) is selected to be larger than the anti-rotational force of the container body 1*a*.

When the rotations of the toner supply container between the set position and the supplying position in both directions are made automatic, the usability is further improved.

The supply tests were carried out with the toner supply container of this embodiment, and the results were satisfactory, and image forming operations were proper for a long term.

The material, the molding method, the configuration and so on of the members are not limited to those described in the foregoing, but may be properly modified by one skilled in the art.

The toner receiving apparatus for receiving the toner supply container may be an image forming unit of a stationary type in which the toner receiving apparatus is fixed to the main assembly of the image forming apparatus or may be an image forming unit of a detachable type in which the toner receiving apparatus is easily detachably mountable to the main assembly of the image forming apparatus. Examples of the image forming unit include a process cartridge comprising as a unit image forming process means such as a photosensitive member, a charger, a developing device and so on, and a developing cartridge comprising a developing device.

[Embodiment 2]

Figure 14:
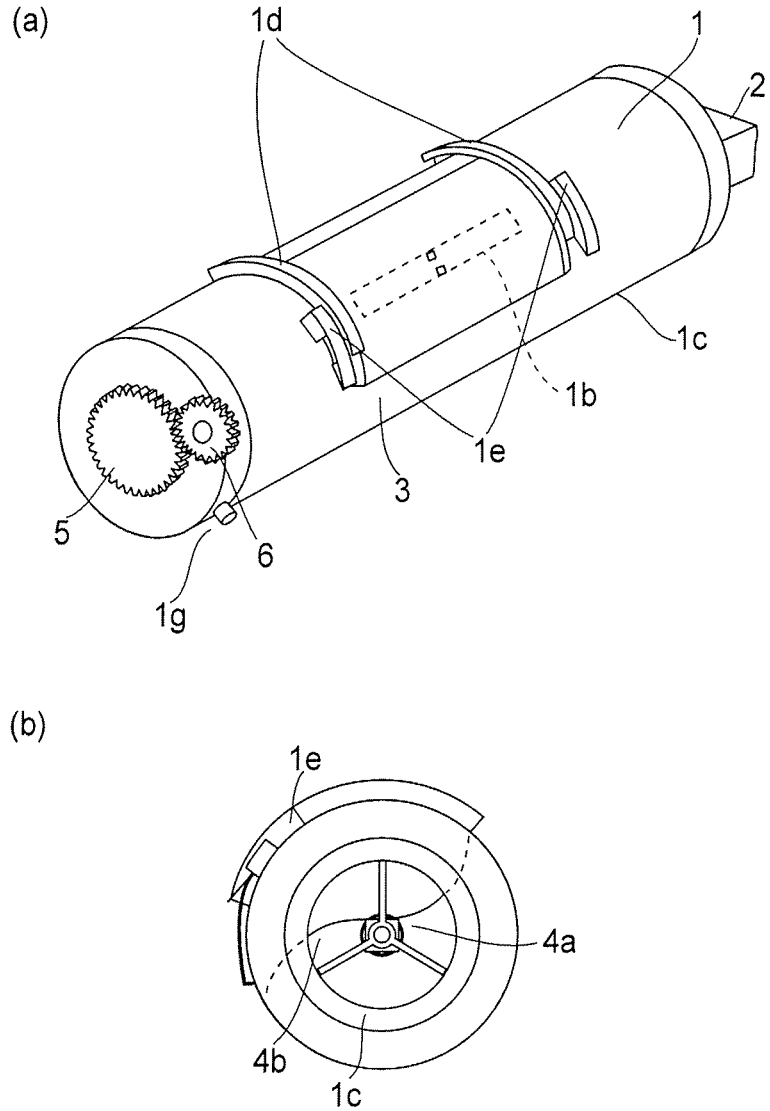
FIG. 14 illustrates a toner supply container, wherein (a) is a perspective view thereof, and (b) is a side view thereof.

Referring to FIG. 14, a toner supply container 1 according to Embodiment 2 will be described. The basic structures of the container are the same as the embodiment, and therefore, the description of the detail structures thereof is omitted for the sake of simplicity.

In Embodiment 1, the interrelating portion of the toner supply container uses the opening projection and the sealing projection. In Embodiment 2, a snap fit type engagement is used. In Embodiment 1, the toner supply container is mounted substantially in the direction perpendicular to the longitudinal direction of the toner supply container. In Embodiment 2, however, the toner supply container is mounted to the toner receiving apparatus substantially in the longitudinal direction of the toner supply container.

This is the main difference of the toner supply container from that of Embodiment 1. In the Figures, the same reference numerals as in Embodiment 1 are assigned to the element having a corresponding function.

Figure 17:
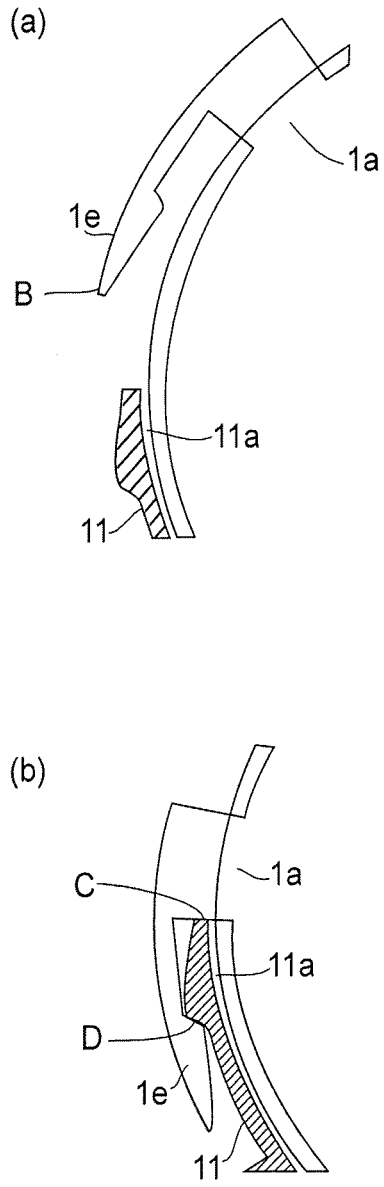
FIG. 17 illustrates a snap fit portion of a toner supply container, wherein (a) is a sectional view when the snap fit portion is in a non-engagement state, and (b) is a sectional view when the snap fit portion is in an engagement state.

As shown in FIGS. 14 and 17, the peripheral surface of the toner supply container 1 is provided with a snap fit portion 1*e* which functions as an interrelating portion (engaging portion) for releasable engagement with the developing device shutter 11. The snap fit portion 1*e* is brought into a hook engagement with the developing device shutter 11 by an overlapping operation relative to the developing device shutter 11 when the toner supply container is manually rotated from the mount position to the set position. At this time, the developing device shutter 11 is kept non-movable by a locking member 13.

With the manual rotation of the toner supply container, the claw portion disposed at the free end portion of the snap fit portion 1*e* abuts the developing device shutter, by which the claw portion deforms, and then, elastically restores to establish a hook engagement therebetween (FIG. 17, (a) to (b)).

In order to simply accomplish the deformation and restoration of the snap fit portion 1*e*, the snap fit portion 1*e* is made of resin material capable of elastic deformation.

With the automatic rotation of the toner supply container in the setting operation, the developing device shutter 11 which is in integral engagement with the snap fit portion 1*e* is lowered, and the toner receiving opening is opened.

With the manual rotation of the toner supply container during the dismounting operation, the developing device shutter 11 is raised by the snap fit portion 1*e*, and the toner receiving opening is closed again.

The snap fit portion 1*e* functions to interrelate the opening operation and closing operation of the developing device shutter 11 with the rotation of the toner supply container.

The portion of the developing device shutter 11 which is hook-engaged with the free end claw of the snap fit portion 1*e* is a snap fit receiving portion 11*a* and has a configuration corresponding to the configuration of the free end claw. They are so constituted that they are not disengaged from each other when the developing device shutter 11 is raised.

On the other hand, they are so constituted that after the developing device shutter 11 is re-closed or resealed, the snap fit portion 1*e* and the developing device shutter 11 are easily released from each other with the rotation of the toner supply container.

The snap fit portion 1*e* accomplished these two functions.

In this example, as shown in FIG. 14, toner supply container is provided with a handle 2 for easy insertion thereof into the toner receiving apparatus substantially along the longitudinal direction, on an end surface of the container body 1*a* longitudinally opposite from the surface having the gears 5 and 6.

Figure 15:
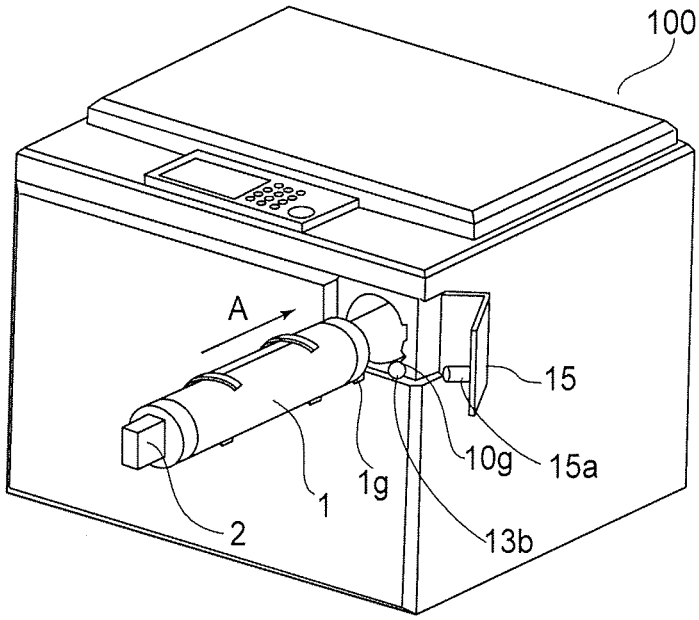
FIG. 15 is a perspective view of a toner supply container which is being mounted to a toner receiving apparatus.

As shown in FIG. 15, an exchange cover 15 for exchanging the toner supply container is opened and closed in a front side of the main assembly of the apparatus. The toner supply container 1 is inserted to the toner receiving apparatus 10 of the main assembly of the image forming apparatus 100 along the longitudinal direction (the axial direction of the feeding member), by the user gripping the handle 2, with the gear (5, 6) side at the leading side.

The leading side end of the toner supply container 1 in the inserting direction is provided with a positioning guide projection 1 *g* (regulating member), and the toner receiving apparatus is provided with a guide portion 10 *g* in the form of a recess corresponding to the positioning guide projection 1*g*. The structure is to regulate the mounting attitude (mounting angle) of the toner supply container 1 in the rotational direction.

The regulating member for regulating the mounting attitude in the rotational direction of the toner supply container 1 is not limited to such a guide projection 1*g*. For example, the described guide portion 1*d* of the container shutter 3 or the snap fit portion 1*e* may be used to regulate the mounting attitude of the toner supply container. In such a case, a cross-sectional configuration of the inlet of the mounting portion of the toner receiving apparatus may correspond to the configuration of the guide portion 1*d* of the snap fit portion 1*e* or the container shutter 3.

Figure 16:
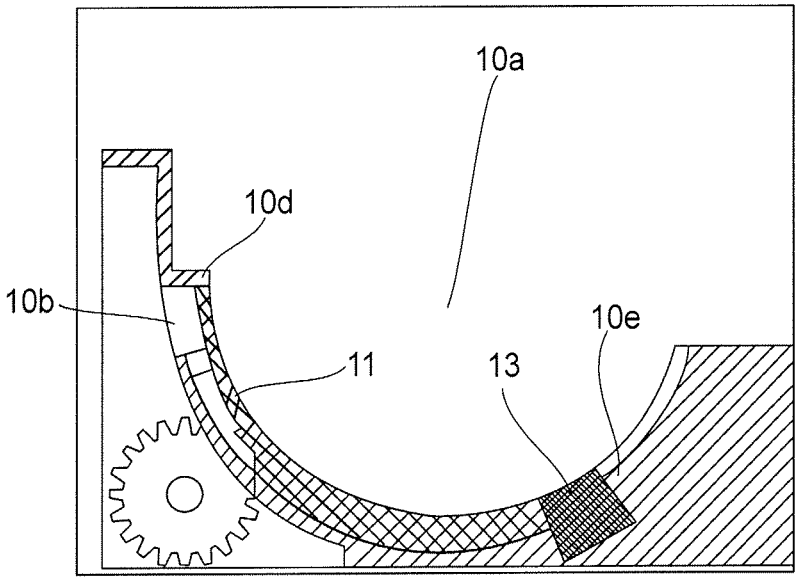
FIG. 16 is a sectional view of a toner receiving apparatus.

The toner receiving apparatus 10, as shown in FIG. 16, has substantially the same structure except for the portion of the developing device shutter 11 which is engaged with the toner supply container (snap fit portion 1*e*).

Figure 18:
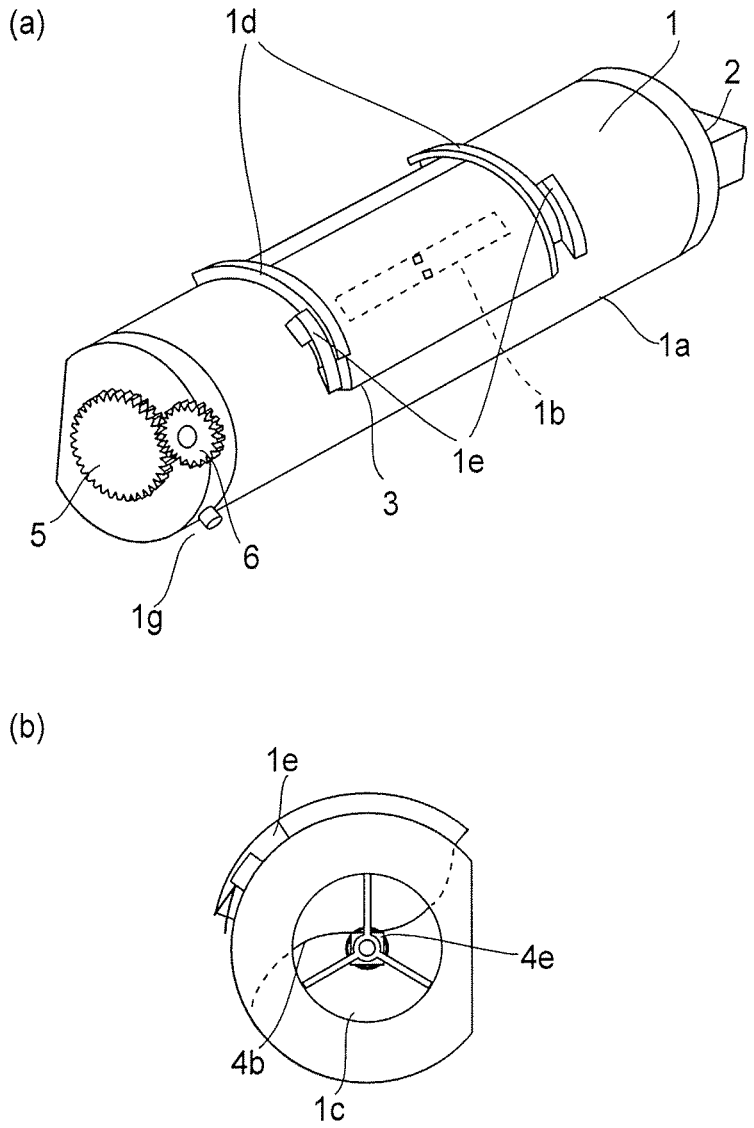
FIG. 18 illustrates a toner supply container having a non-cylindrical shape, wherein (a) is a perspective view thereof, and (b) is a sectional view thereof.

As shown in FIG. 18, the shape of the container may be a cylindrical from which a part is removed.

The setting operation and the dismounting operation of the toner supply container will be described as to the case using the snap fit portion 1*e*.

(Setting Operation of Toner Supply Container)

Figure 19:
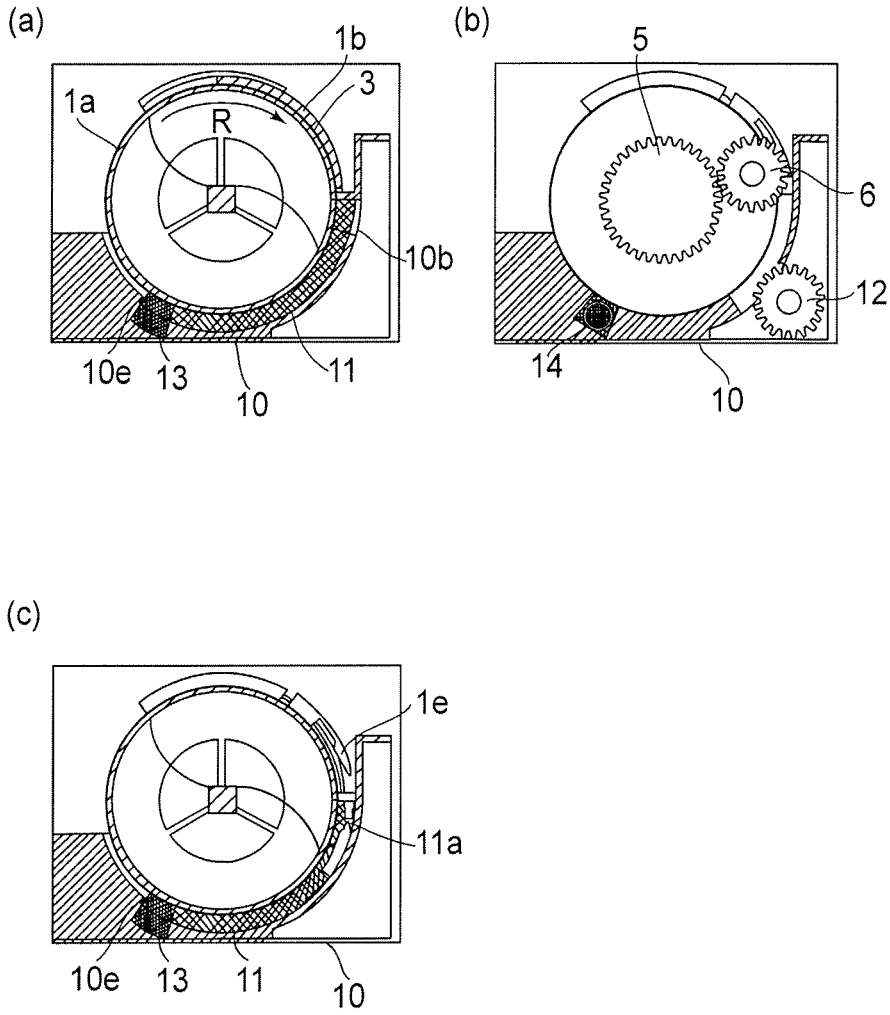
FIG. 19 illustrates sectional side views ((a)-(c)) of a toner supply container placed at the mounting position.
Figure 20:
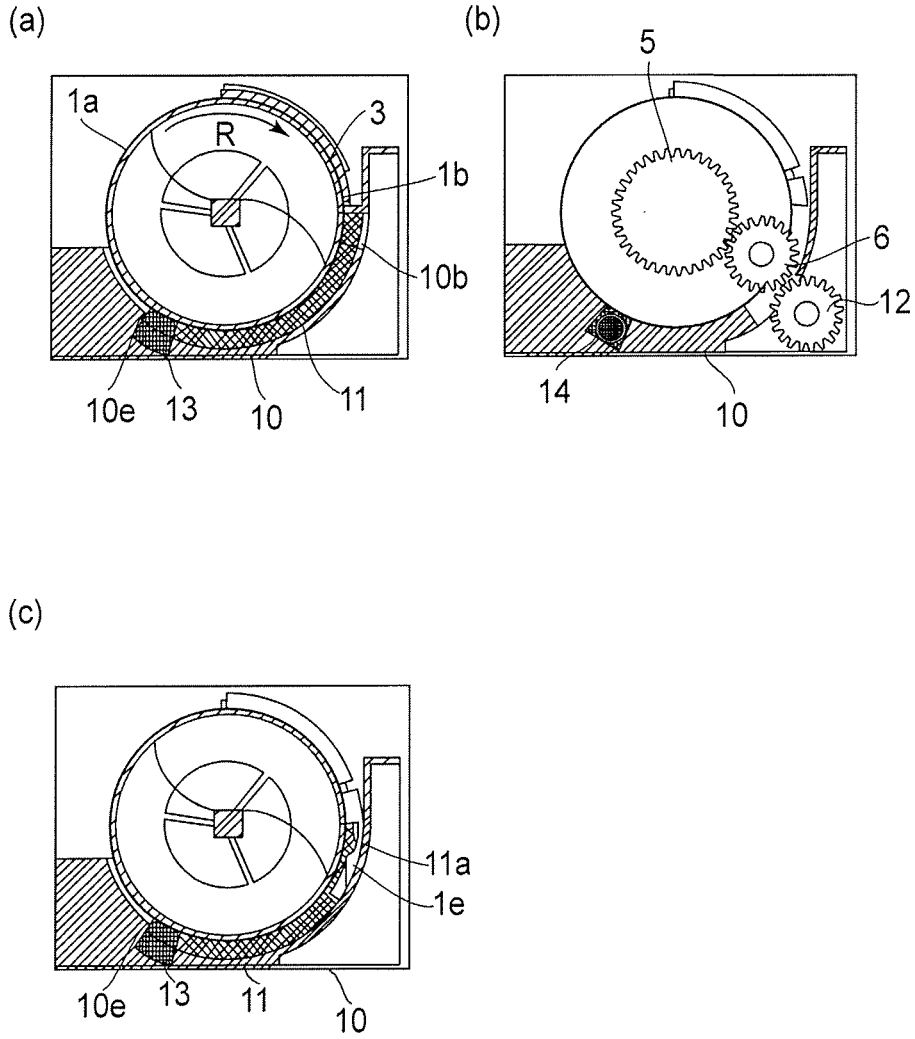
FIG. 20 is sectional side views ((a)-(c)) of a toner supply container placed at the set position.
Figure 21:
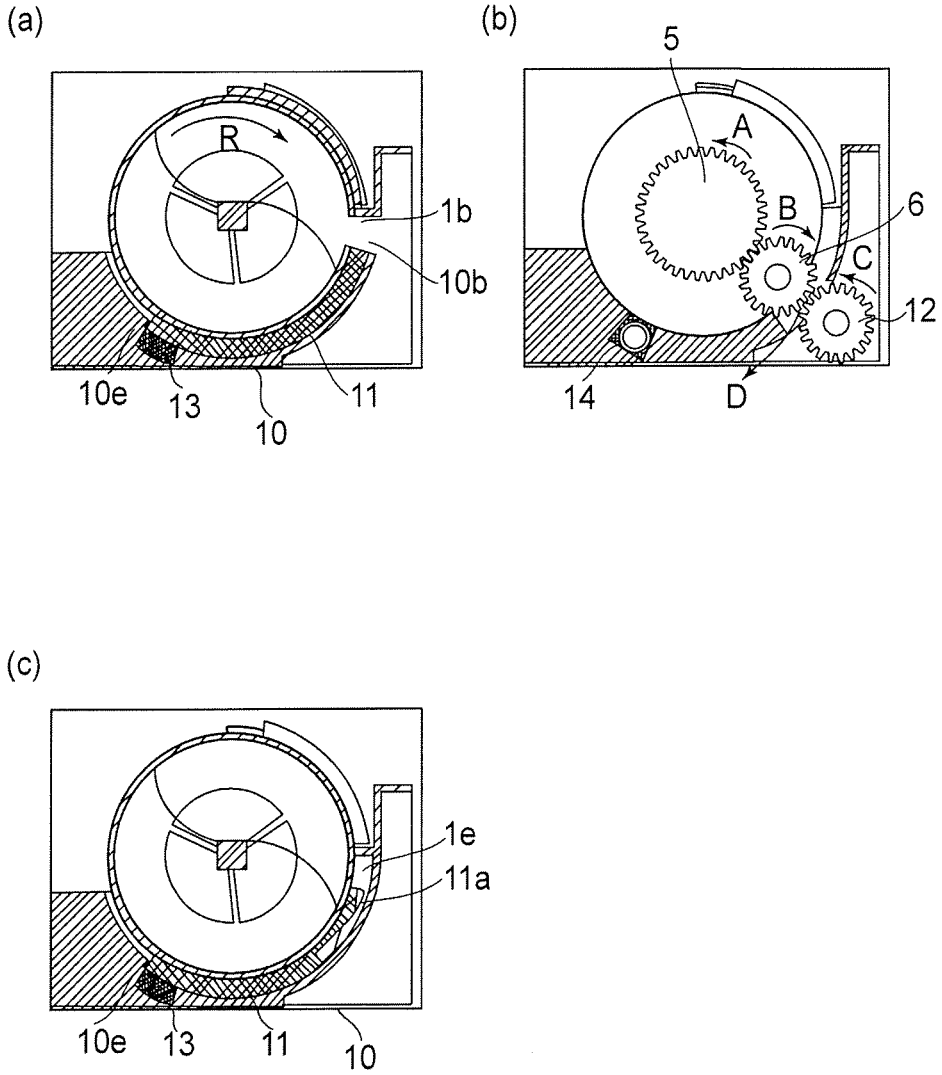
FIG. 21 is sectional side views ((a)-(c)) of a toner supply container placed at the supplying position.

Referring to FIG. 19 to FIG. 21, the setting operation of the toner supply container 1 will be described. In this embodiment, the rotation of the toner supply container 1 from the mount position to the set position is carried out by the user, and the rotation of the toner supply container 1 from the set position to the supplying position is automatically carried out by the toner receiving apparatus.

FIG. 19 shows a state in which the toner supply container is at the mount position, FIG. 20 shows a state in which the toner supply container is at the set position, and FIG. 21 shows a state in which the toner supply container is at the supplying position.

FIGS. 10-12 show the positional relation among the container shutter 3, the developing device shutter 11, the toner discharge opening 1*b* and the toner receiving opening 10*b* at (a) of this Figure. FIGS. 10-12 show a positional relation between the second gear 6 and the driving gear 12 of the toner receiving apparatus 10 at (b) of this Figure. FIGS. 10-12 show a positional relation between the snap fit portion 1*e* and the snap fit receiving portion 11*a* at (c) of this Figure.

(Mounting Step in Setting Operation)

First, the user opens the exchange cover 15. The user inserts the toner supply container 1 toward the mounting portion of the toner receiving apparatus while aligning the positioning guide projection 1 *g* with the guide portion 10*g*.

At this time, as shown in (a) of FIG. 19, the toner discharge opening 1*b* is closed by the container shutter 3, and the toner receiving opening 10*b* is closed by the developing device shutter 11. The developing device shutter 11 is locked by the locking member 13 so that opening movement thereof is prevented. As shown in FIG. 19, (b), the driving gear 12 of the toner receiving apparatus 10 and the second gear 6 of the toner supply container 1 are spaced apart, so that driving connection is disabled. As shown in FIG. 19, (c), the snap fit portion 1*e* of the toner supply container is away from the snap fit receiving portion 11*a* of the developing device shutter, so that engagement therebetween is disabled.

(Manual Rotation Step in Setting Operation)

The toner supply container 1 placed at the mount position is rotated toward the set position in the direction indicated by arrow R in FIG. 19 (the direction opposite the rotational direction of the feeding member 4).

With the manual rotation of the toner supply container 1, the second gear 6 is brought into meshing engagement with the driving gear 12. At this time when the toner supply container reaches the set position, the second gear 6 begins to engage with the driving gear 12, so that drive transmission from the driving gear 12 to the second gear 6 is enabled. FIG. 20 shows the end of the rotation using the handle by the user, and at (b) of this Figure, the second gear 6 is brought into meshing engagement with the driving gear 12, and therefore, the drive-transmission is enabled.

With the manual rotation of the toner supply container 1, as shown in FIG. 17, (a), the snap fit portion 1*e* deforms in the direction of an arrow B to engage into the snap fit receiving portion 11*a*, thus establishing the hook engagement (FIG. 17, (b)).

By the user operation, the snap fit portion 1*e* further pushes the developing device shutter 11 (C at (b) of FIG. 17). At this time, however, the developing device shutter 11 is locked by the locking member 13, and therefore, any further rotation of the toner supply container is prevented. This is the end of the user operation.

In this embodiment, as described in the foregoing, since the developing device shutter 11 is locked, the snap fit portion 1*e* is prevented from lowering the developing device shutter 11 before the snap fit portion 1*e* is engaged into the snap fit receiving portion 11*a*. Therefore, an interrelation defect between the toner supply container and the developing device shutter can be prevented.

When the toner supply container is at the set position, the toner discharge opening 1*b* and the toner receiving opening 10*b* are still closed (FIG. 20, (a)).

Then, the user closes the exchange cover 15. On the other hand, the exchange cover 15 is provided with a release member 15*a* (regulation releasing member) in the form of a projection, and the developing device shutter is released in interrelation with the closing operation of the cover.

More particularly, as shown in FIG. 9, when the user closes the cover 15, the release member 15*a* of the covering member 15 pushes the receiving portion 13*b* of the locking member 13 of the developing device shutter 11 toward the rear side in the longitudinal direction. At this time, the locking member 13 is urged by the spring member 14, but the release member 15*a* pushes the locking member 13 against the urging force, and therefore, the developing device shutter is released from the locking. Thereafter, the movement of the developing device shutter 11 in the unsealing or opening direction is permitted.

(Automatic Rotation Step in Setting Operation)

The driving gear 12 starts to rotate by the driving motor in interrelation with the user's closing operation of the exchange cover 15.

Then, the toner supply container placed at the set position receives an inward pushing force (E, in (b) of FIG. 21) through the second gear 6, and the toner supply container starts the automatic rotation toward the supplying position.

With the automatic rotation of the toner supply container, the movement of the developing device shutter 11 in the opening direction is started by the snap fit portion 1*e*.

Finally, when the toner supply container reaches the supplying position, the toner discharge opening 1*b* is completely uncovered by the developing device shutter 11, and the toner receiving opening 10*b* is completely uncovered by the container shutter, and the positions of the openings are aligned with each other ((a) in FIG. 21).

The automatic rotation of the toner supply container 1 is stopped by the developing device shutter abutting against the stopper 10*e* ((a), in FIG. 21).

Thereafter, with further rotation of the driving gear 12, the feeding member 4 is rotated relative to the thus stopped toner supply container, by which the toner is fed and discharged.

(Dismounting Operation of Toner Supply Container)

The description will be made as to dismounting of the toner supply container from the toner receiving apparatus for some reason or another.

First, the user opens the exchange cover 15. Then, the user operates the handle 2 to rotate the toner supply container in the direction opposite to the direction of the arrow R in FIG. 21. More particularly, the toner supply container placed at the supplying position is rotated back to the mount position through the set position by the user operation.

At this time, the developing device shutter 11 is raised by the snap fit portion 1*e* of the toner supply container 1, and the toner receiving opening 10*b* is closed. Concurrently, the toner discharge opening 1*b* rotates back to the position where it is closed by the container shutter 3 ((a) in FIG. 20). More particularly, the container shutter abuts the stopper portion of the toner receiving apparatus and is stopped thereby, and the toner supply container is rotated from this state by which the toner discharge opening is re-closed or resealed by the container shutter.

When the toner supply container is rotated from the set position to the mount position, the snap fit portion 1*e* is released from the developing device shutter 11, and thereafter, the toner supply container is rotated relative to the developing device shutter.

Furthermore, with the rotation of the toner supply container from the set position to the mount position, the second gear 6 revolves to release the engagement with the driving gear 12, and becomes not engageable with the driving gear 12 ((b) in FIG. 19).

The rotation of the toner supply container from the supplying position to the mount position is stopped by the stopper portion provided on the guide portion 1*d* of the container shutter 3 abutting the container shutter 3.

Then, the toner supply container 1 at the mount position is taken out of the toner receiving apparatus 10 by the user.

This is the end of the dismounting operation of the toner supply container.

The backward rotation of the toner supply container from the supplying position to the set position can be carried out automatically, also in this embodiment.

More particularly, when the toner supply container is at the supplying position, the driving gear 12 is rotated in the direction opposite to that in the setting operation, so that opposite force is applied to the toner supply container.

By doing so, the toner supply container is rotated back to the position where the developing device shutter closes the toner receiving opening. At this time, the toner discharge opening is resealed by the container shutter.

In this case, too, the force applied to the toner supply container (in the direction opposite the direction of the inward pushing force) is selected to be larger than the anti-rotational force of the container body 1*a*.

When the rotations of the toner supply container between the set position and the supplying position in both directions are made automatic, the usability is further improved.

The similar advantage effects as with Embodiment 1 are provided even when the interrelating mechanism between the toner supply container and the developing device shutter and the mounting direction of the toner supply container are different.

[Embodiment 3]

Figure 22:
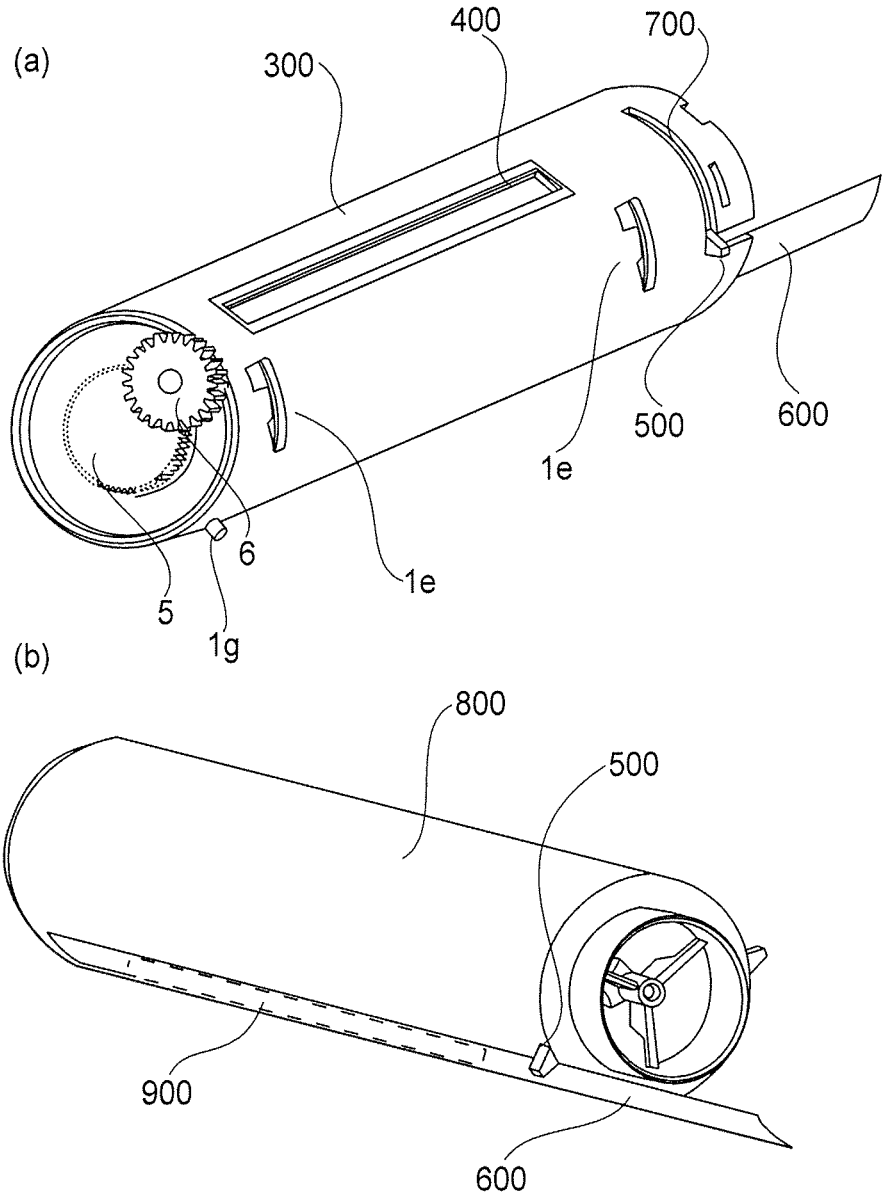
FIG. 22 illustrates a toner supply container having a dual cylindrical structure, wherein (a) is a perspective view, and (b) is a perspective view of an inner cylinder.
Figure 23:
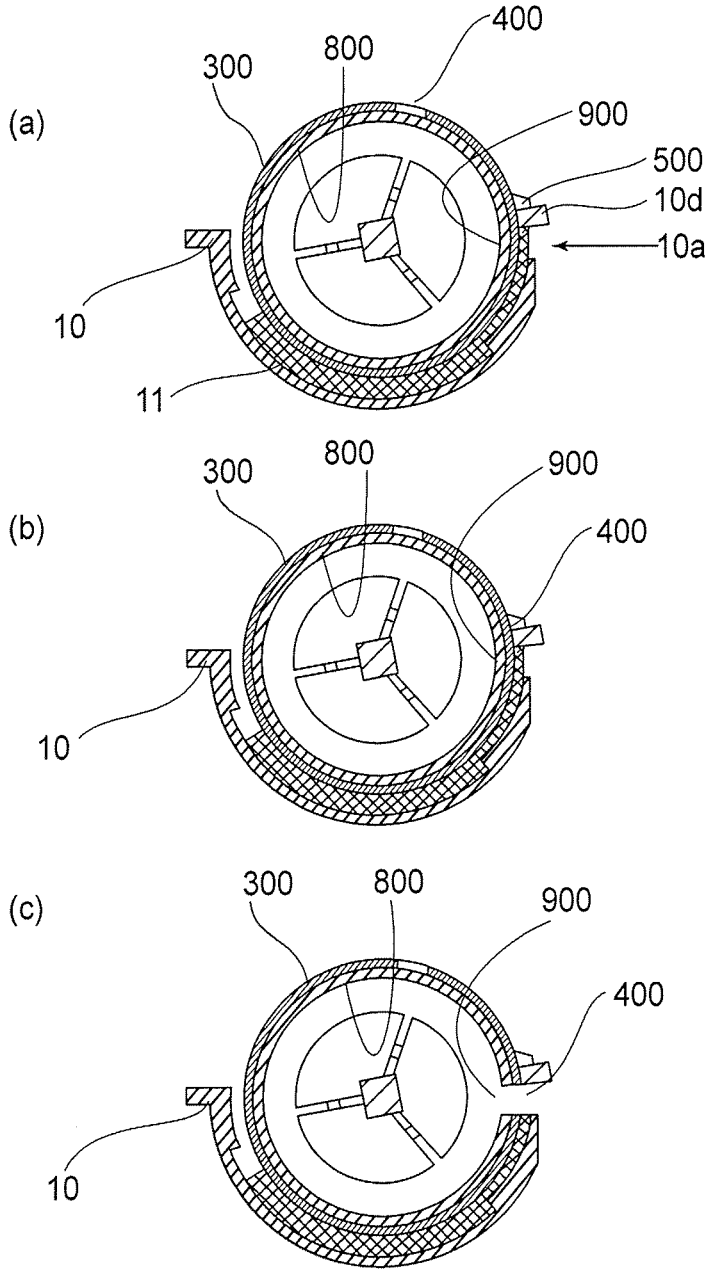
FIG. 23 is a sectional view of the toner supply container (a) of the dual cylindrical type placed at the mounting position, a sectional view (b) thereof placed at the set position, and a sectional view (c) thereof placed at the supplying position.

Referring to FIGS. 22 and 23, Embodiment 3 will be described. The basic structures of this embodiment are the same as Embodiments 1 and 2, and therefore, the detailed description of the common parts are omitted. In the Figures, the same reference numerals as in Embodiments 1 and 2 are assigned to the element having a corresponding function. In FIG. 22, (a) is a perspective view of the entirety of the toner supply container, and (b) is a perspective view of an inner cylinder. In FIG. 23, (a) shows the state when an outer cylinder is at a mount position, and (b) shows the state when the outer cylinder is at a set position, and (c) shows the state when the outer cylinder is at a supplying position.

In the Embodiments 1 and 2, the container body 1*a* containing the toner is rotated, but in the present embodiment, a portion not functioning as the toner accommodating portion is rotated.

As shown in FIG. 22, the toner supply container comprises an inner cylinder 800 containing the toner and an outer cylinder 300 rotatable around the inner cylinder (dual cylindrical structure).

The inner cylinder is provided with a toner discharge opening 900 for permitting discharging of the toner, and the outer cylinder is provided with a toner discharge opening 400 for permitting discharging of the toner. The inner cylinder is provided with a locking portion for locking engagement with the toner receiving apparatus substantially to prevent rotation thereof.

The toner discharge opening provided in the inner cylinder and the outer cylinder are not aligned with each other at least positionally before the mounting of the toner supply container, and therefore, the openings are not in fluid communication with each other. In other words, in this example, the outer cylinder functions as the container shutter 3 described in the foregoing.

The toner discharge opening 900 of the inner cylinder is hermetically sealed by sealing film 600 welded to the outer surface of the inner cylinder around the toner discharge opening 900. The sealing film 600, when the toner supply container is at the mount position (before the toner supply container is rotated), is peeled off by the user.

In order to prevent the toner leakage into between the inner cylinder and the outer cylinder, an elastic sealing member is provided around the toner discharge opening 900 of the inner cylinder (inside of a welded portion of the sealing film), and the elastic sealing member is compressed by the inner cylinder and the outer cylinder in a predetermined degree.

Gears 5 and 6 (drive transmitting means) and a snap fit portion 1*e* are provided on the outer cylinder having a closed bottom. More particularly, the gears 5 and 6 are provided on one longitudinal end of the outer cylinder (bottom surface of the cylindrical portion), and the snap fit portion 1*e* is provided on the outer surface of the outer cylinder.

The container of this embodiment is assembled by engagement between the projection 500 (member to be guided or guided member) provided on the inner cylinder and a recess (elongated hole) 700 (guiding member) provided on the outer cylinder. This is effective to regulate the position of the outer cylinder relative to the inner cylinder in the longitudinal direction of the toner supply container. The relation of the recess and projection may be reversed in the guiding member and the guided member.

Referring to FIG. 23, the setting operation and the dismounting operation of the toner supply container will be described.

(Setting Operation of Toner Supply Container)

First, the user opens the exchange cover 15, and inserts the toner supply container into the toner receiving apparatus.

At the time when the toner supply container is at the mount position, the toner discharge opening of the inner cylinder is at a position opposed to the toner receiving opening with the developing device shutter therebetween, and on the other hand, the toner discharge opening of the outer cylinder is not opposed to the toner receiving opening, but substantially faces up. The second gear 6, similarly to Embodiments 1 and 2, is not engaged with the driving gear 12 and is at a position away from it (FIG. 23, (a)).

Then, the sealing film is peeled off the container by the user.

Thereafter, the outer cylinder is rotated to a set position by the user relative to the inner cylinder locked with the toner receiving apparatus (not rotatable relative thereto).

When the toner supply container is at the set position, the snap fit portion of the toner supply container is in hook engagement with the developing device shutter. Since the developing device shutter is locked, the toner receiving opening is closed. At this time, the toner discharge opening of the outer cylinder is not in fluid communication with the toner discharge opening of the inner cylinder (FIG. 23, (b)).

Thereafter, the exchange cover 15 is closed by the user.

In interrelation with the closing operation of the exchange cover 15, the driving gear 12 starts rotation, and then, the outer cylinder (toner discharge opening) automatically rotates toward the supplying position relative to the inner cylinder locked to the toner receiving apparatus by the principle similar to the case of Embodiments 1 and 2. With the automatic rotation of the toner supply container, the developing device shutter is lowered by the snap fit portion.

When the toner supply container reaches the supplying position (toner discharge opening of the outer cylinder), the toner receiving opening is opened or unsealed, and the toner discharge opening of the outer cylinder is aligned with the toner discharge opening of the inner cylinder. As a result, the toner discharge opening of the inner cylinder, the toner discharge opening of the outer cylinder and the toner receiving opening are all positionally aligned to enable the toner supply (FIG. 23, (c)).

As regards the dismounting operation of the toner supply container, the user directs the outer cylinder placed at the supplying position is rotated toward the mount position in the direction opposite to the directing during the setting operation, by which the second gear 6 revolves to a position away from the driving gear 12. At this time, the resealing operation for the toner discharge opening of the inner cylinder and for the toner receiving opening is carried out interrelatedly.

At this time when the toner supply container moves from the supplying position to the mount position, the toner discharge opening 400 of the outer cylinder is kept open, but the toner discharge opening 900 of the inner cylinder is resealed by the outer cylinder. And, the toner discharge opening 400 of the outer cylinder faces up, the amount of toner scattering is very small, if any.

As described in the foregoing, with the structure of this example, the similar advantageous effects are provided as with Embodiments 1 and 2.

In the foregoing, the outer cylinder is rotatable relative to the inner cylinder, but alternatively, the inner cylinder having a closed end may be rotatable relative to the outer cylinder non-rotatably locked relative to the toner receiving apparatus. More particularly, a snap fit portion 1*e* is provided on the peripheral surface of the inner cylinder, and the first gear 5 and the second gear 6 are provided on the end surface (bottom surface of the cylindrical portion) of the inner cylinder. On the other hand, the outer cylinder is provided with a guide hole for guiding the movement of the snap fit portion while penetrating the snap fit portion 1*e*. With such a structure, when the toner supply container is at the mount position, the toner discharge opening of the outer cylinder is aligned with the toner receiving opening, and the toner discharge opening of the inner cylinder faces up. Thereafter, the user manually rotates the toner supply container (inner cylinder), and then, the automatic rotation of the toner supply container (inner cylinder) by the rotation of the driving gear 12 is carried out, and the toner discharge opening of the inner cylinder is aligned with the toner discharge opening of the outer cylinder and with the toner receiving opening. When the toner supply container is taken out, similarly to the foregoing embodiments, the user rotates the toner supply container from the supplying position to the mount position, and then, the toner supply container can be taken out.

[Embodiment 4]

Figure 24:
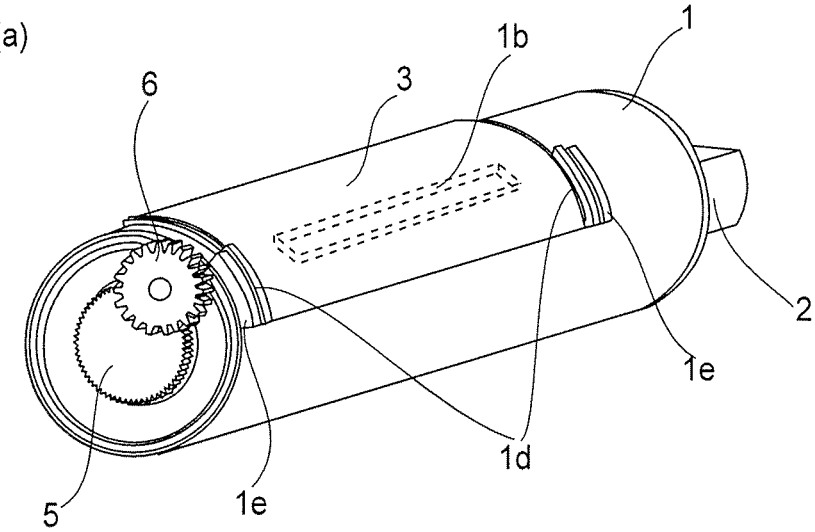
FIG. 24 illustrates a toner supply container having a stepped gear, wherein (a) is a perspective view thereof, and (b) is a perspective view of the stepped gear.
Figure 24:
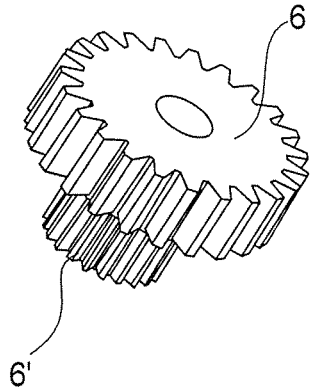

Referring to FIG. 24, a toner supply container 1 according to Embodiment 4 will be described. The basic structures of the container are the same as the embodiment, and therefore, the description of the detail structures thereof is omitted for the sake of simplicity. In the Figures, the same reference numerals as in the foregoing embodiments are assigned to the element having a corresponding function.

As shown in FIG. 24, the second gear 6 is a stepped gear as is different from Embodiments 1 and 2. The second gear 6 has a gear 6', too at the lower position. The gear 6' is fixed to co-axially rotate integrally with the second gear 6. The gear 6' is in meshing engagement with the first gear 5.

By doing so, the rotational speed of the feeding member can be set at a relatively lower level, without changing the rotational speed of the driving gear 12, since the first gear 5 directly engaged with the feeding member is made larger (the number of the teeth is also large) as compared with Embodiment 1. On the other hand, the diameter of the second gear 6 is not made smaller in consideration of the amount of the automatic rotation of the toner supply container during the setting operation, or the number of the teeth is not made smaller, either, and the second gear 6 has the similar structure as in Embodiments 1 and 2. In this embodiment, the second gear 6 has a stepped gear structure, and the gear 6' is provided to transmit the rotating force from the second gear 6 to the first gear 5.

The first gear 5 has a diameter of 31 mm and a number of teeth of 62; the second gear 6 has a diameter of 23 mm and a number of the teeth of 23; and the gear 6' has a diameter of 11 mm and a number of teeth of 22. The driving gear 12 is the same as Embodiments 1 and 2.

The same advantageous effects as with Embodiments 1 and 2 can be provided by this embodiment.

[Embodiment 5]

Figure 25:
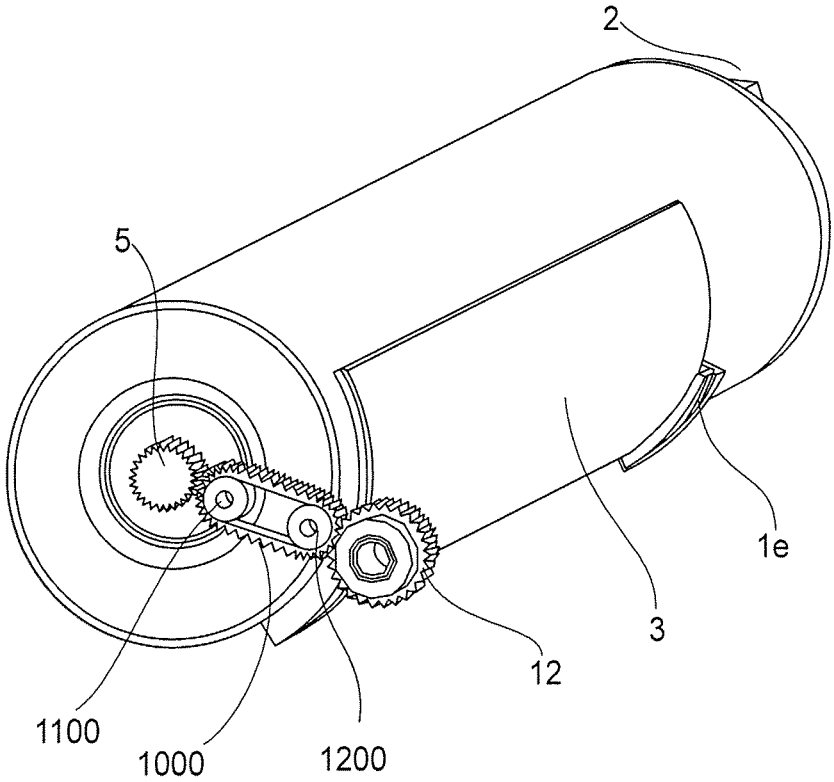
FIG. 25 is a perspective view illustrating a toner supply container provided with a drive transmission belt.

Referring to FIG. 25, Embodiment 5 will be described. The basic structures of this embodiment are the same as Embodiments 1 and 2, and therefore, the detailed description of the common parts are omitted. In the Figures, the same reference numerals as in Embodiments 1 and 2 are assigned to the element having a corresponding function.

In the foregoing embodiments, the drive transmitting means of the toner supply container for engagement with the driving gear 12 is a gear (second gear 6), but in this embodiment, the drive transmitting means for engagement with the driving gear 12 is a drive transmission belt 1000, as shown in FIG. 25. The gear 5 in meshing engagement with the drive transmission belt is rotatable co-axially with the feeding member 4 similarly to the foregoing embodiments.

The drive transmission belt 1000 is provided with outer teeth for engagement with the teeth of the driving gear 12 on the outer surface thereof. The drive transmission belt 1000 is trained around two pulleys 1100 and 1200 (rotatable supporting member) with a predetermined tension. The shaft portions of the pulleys are rotatably supported on an end surface of the toner supply container.

To prevent sliding motion between the drive transmission belt and each of the pulleys during the automatic rotation step of the toner supply container, it is preferable that at least one of the inner surface of the drive transmission belt and the outer surface of each of the pulley is treated for high friction. In this embodiment, the inner surface of the drive transmission belt and the outer surfaces of the pulleys are subjected to a surface roughening treatment. In order to prevent the sliding between the drive transmission belt and each of the pulleys, the drive transmission belt and the pulleys may be made of high friction property material with which the high friction treatment is not necessary. Alternatively, the inner surface of the drive transmission belt may be provided with teeth, and correspondingly, the outer surface of each of the pulleys may be provided with teeth to prevent the slippage therebetween with high reliability.

Since the center of rotation of the outside pulley 1200 supporting the drive transmission belt 1000 is eccentric from the center of rotation of the toner supply container, the automatic rotation of the toner supply container is possible similarly to Embodiments 1 and 2.

In this embodiment, the gear 5 is provided to reverse the rotational direction of the drive transmission belt in consideration of the toner feeding and discharging properties of the feeding member, but they may be omitted. More particularly, the position of the pulley 1200 (center of rotation) is not changed, and the position of the pulley 1100 (center of rotation) is aligned with the center of rotation of the toner supply container. The pulley 1100 is co-axially connected with the feeding member 4, and further, the drive transmission belt 1000 is trained on the pulleys in the form of "8".

With such trained arrangement of the drive transmission belt 1000, the toner feeding and discharging properties can be made satisfactory without necessity of providing another gear 5 (reversing mechanism). In other words, the automatic rotation of the toner supply container is accomplished without deteriorating the toner feeding and discharging properties.

In addition, this embodiment employs a drive transmission belt 1000 in place of the second gear 6, but a drive transmission belt 1000 may be used in place of the first gear 5, for example. In such a case, the second gear 6 may be the same as with Embodiments 1 and 2.

[Embodiment 6]

Figure 26:
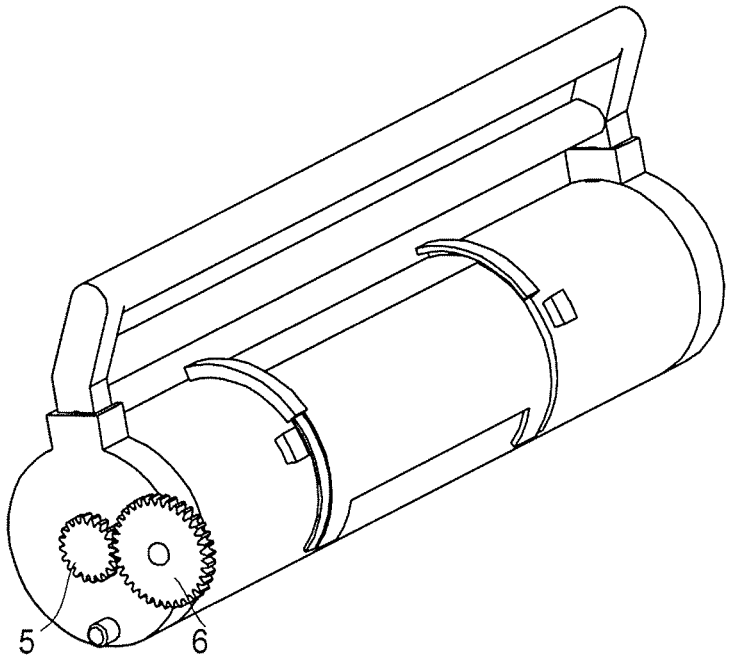
FIG. 26 is a perspective view (a) and a sectional view (b) of a toner supply container in which the sizes of the drive transmission gears are different.
Figure 26:
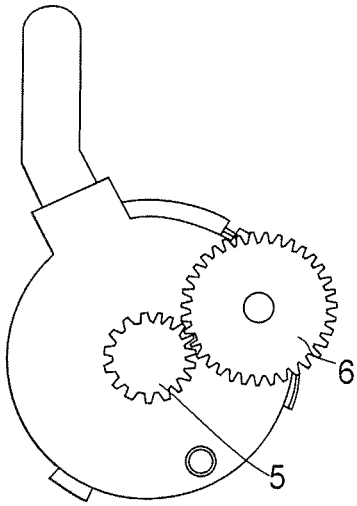

Referring to FIG. 26, a toner supply container 1 according to Embodiment 6 will be described. The basic structures of the container are the same as Embodiments 1 and 2, and therefore, the description of the detail structures thereof is omitted for the sake of simplicity. In the Figures, the same reference numerals as in the foregoing embodiments are assigned to the element having a corresponding function.

As shown in FIG. 26, the toner supply container 1 has a first gear 5 and a second gear 6 wherein the relation between the diameters thereof are opposite to the cases of Embodiments 1 and 2, more particularly, the first gear 5 has a diameter of 20 mm, and the second gear 6 has a diameter of 40 mm.

In this embodiment, the mounting position, with respect to the circumferential direction, of the second gear 6 relative to the container body 1*a* is selected to provide the similar advantageous effects as with Embodiments 1 and 2.

More particularly, when the toner supply container 1 is at the mount position, the second gear 6 is not in meshing engagement with the driving gear 12, and when the toner supply container 1 is at the set position, the second gear 6 is brought into meshing engagement with the driving gear 12.

In this embodiment, as compared with Embodiment 1, the rotational speed of the first gear 5 driven by the rotating force of the second gear 6 provided from the driving gear 12 is twice that of Embodiment 1 because of the gear ratio. Thus, the rotational speed of the feeding member can be made larger, and the toner discharging speed of the discharge from the toner supply container 1 can be made larger.

On the other hand, there is a possibility that torque required to stir and feed the toner is larger, and therefore, the gear ratio between the two gears is selected in consideration of the kind of the contained toner (difference in the specific gravity depending on whether the toner is magnetic or non-magnetic), the amount of the contained toner, the output of the driving motor or the like.

In order to further raise the toner discharging speed, the diameter of the first gear 5 is made further smaller, and the second gear is made larger.

If the torque requirement is important, the diameter of the first gear 5 is made large, and the diameter of the second gear is made small as in Embodiments 1 and 2.

[Embodiment 7]

Figure 27:
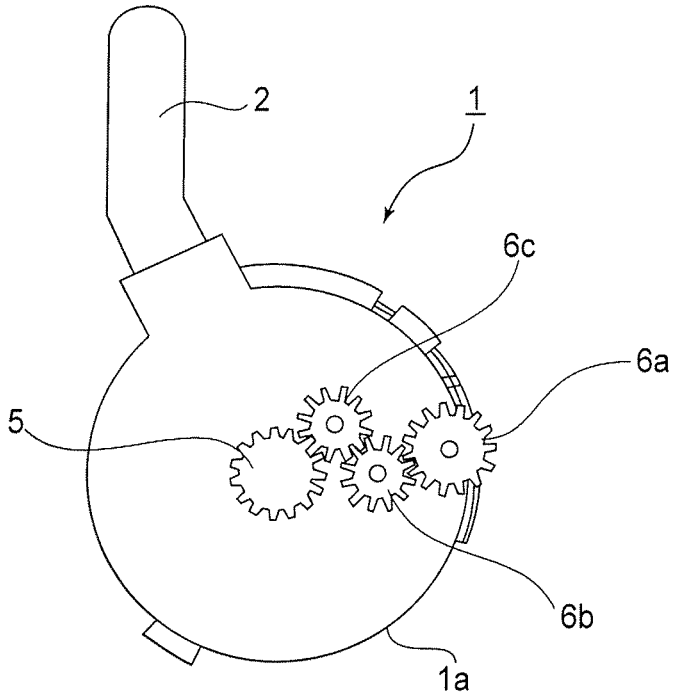
FIG. 27 is a sectional view of a toner supply container provided with four drive transmission gears.

Referring to FIG. 27, a toner supply container 1 according to Embodiment 7 will be described. The basic structures of the container are the same as Embodiments 1 and 2, and therefore, the description of the detail structures thereof is omitted for the sake of simplicity. In the Figures, the same reference numerals as in Embodiment 1 are assigned to the element having a corresponding function.

In this embodiment, the number of the drive transmission gears (drive transmitting means) is larger than in Embodiments 1 and 2.

More particularly, in Embodiments 1 and 2, the driving force is transmitted to the feeding member 4 by two gears 5 and 6. As shown in FIG. 27, the driving force is transmitted to the feeding member 4 by four gears 5, 6*a*, 6*b* and 6*c*.

With the larger number gear case, the similar advantageous effects as with said Embodiments 1 and 2 can be provided. The gears 6*a*, 6*b* and 6*c* are rotatably supported on the container.

As shown in FIG. 27, the number of the gears which transmit the driving to the first gear 5 is odd, the rotational direction of the gear 6*a* (drive transmission member, driving force receiving member) for directly receiving the rotational drive from the driving gear 12 is opposite from the rotational direction of the first gear 5. Therefore, the rotational direction of the feeding member 4 can be made couterclockwise in FIG. 12. This permits the upward feeding of the toner toward the toner discharge opening disposed at a side of the feeding member 4, and therefore, the toner feeding and discharging efficiencies can be enhanced.

When the toner supply container receives the rotational driving force from the driving gear 12, the rotational direction of the gear 6*a* that is rotatably supported at a position remotest from the rotational center of the toner supply container, among the gears 6*a*-6*c*, is the same as the automatic rotational direction of the toner supply container.

Therefore, in this embodiment, similarly to Embodiments 1 and 2, the automatic rotation in the setting operation of the toner supply container can be properly carried out.

As described in the foregoing, when the toner supply container is provided with three or more drive transmission gears, the number of the gears is selected properly in consideration of the toner feeding and discharging properties, that is, the rotational direction of the feeding member. In this embodiment, the number of the drive transmission gears provided on the toner supply container is even.

From the standpoint of reducing the manufacturing cost by reducing the number of the constituent elements of the toner supply container, Embodiments 1 and 2 are preferable since only one gear is used to transmit the driving force to the first gear 5.

[Embodiment 8]

Figure 28:
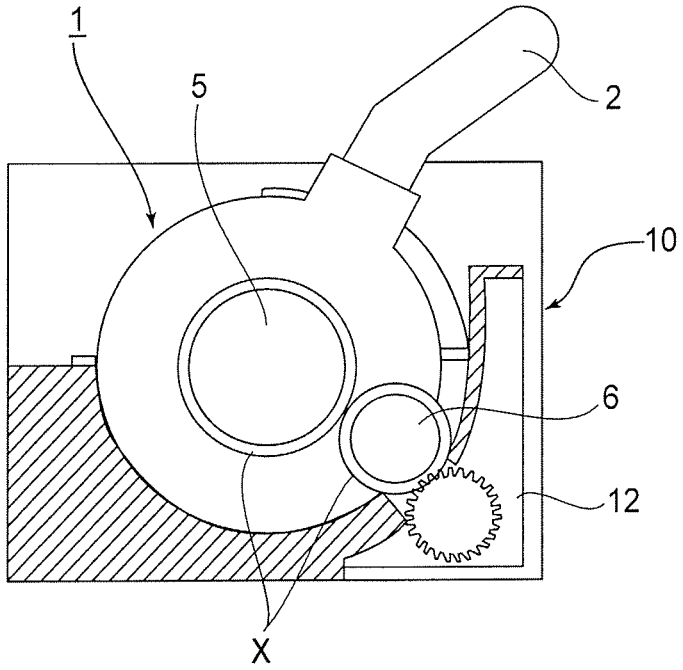
FIG. 28 is a sectional view of a toner supply container provided with a friction wheel.

Referring to FIG. 28, a toner supply container 1 according to Embodiment 8 will be described. The basic structures of the container are the same as Embodiments 1 and 2, and therefore, the description of the detail structures thereof is omitted for the sake of simplicity. In the Figures, the same reference numerals as in Embodiment 1 are assigned to the element having a corresponding function.

Embodiments 1 and 2 use gears as the drive transmitting means (first gear 5 and second gear 6). In this embodiment, as shown in FIG. 28, the drive transmitting means comprises a first friction wheel 5' and a second friction wheel 6' which have engaging or contacting surfaces engageable or contactable with each other for drive transmission, the surfaces being made of material exhibiting a high frictional resistance. The driving gear 12 of the toner receiving apparatus is similar to the embodiment.

Examples of the material X exhibiting a high frictional resistance include rubber, sand paper, adhesive tape or the like. In this embodiment, an elastic member of rubber material is used which has high frictional resistance. In order to properly transmit the driving force, a predetermined degree of pressure is imparted between the friction wheels. In order to prevent slippage between the friction wheels, the pressure to be imparted therebetween is properly adjusted depending on the resistance level of the frictional resistance material.

The rubber surface of the second friction wheel 6' is engaged with the driving gear 12, and therefore, the teeth of the driving gear 12 bites into the rubber surface so that engagement is like a meshing engagement between gears. With this structure of this embodiment, the rotational driving force from the toner receiving apparatus to the toner supply container is properly transmitted.

This embodiment using the friction wheels as the drive transmitting means also accomplish the automatic rotation in the setting operation of the toner supply container similarly to Embodiments 1 and 2.

In the sense that inward pushing force is efficiently produced, the use of the gears is preferable.

[Embodiment 9]

Figure 29:
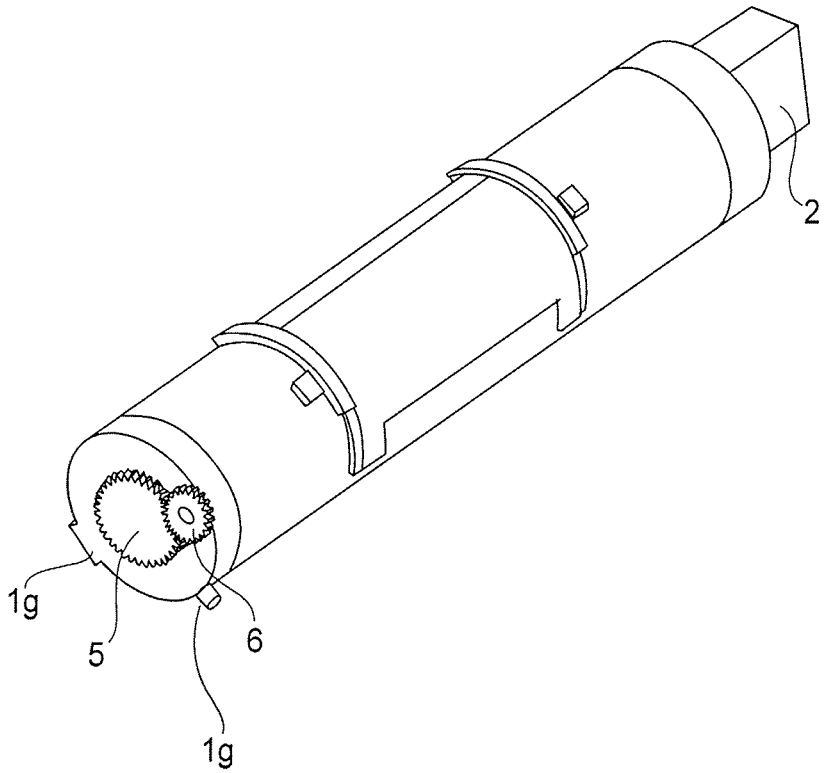
FIG. 29 is a sectional view of a toner supply container wherein the sizes of the drive transmission gears are different, and the positions are different.

Referring to FIG. 29, a toner supply container 1 according to Embodiment 9 will be described. The basic structures of the container are the same as the Embodiments 1 and 2, and therefore, the description of the detail structures thereof is omitted for the sake of simplicity. In the Figures, the same reference numerals as in the foregoing embodiment are assigned to the element having a corresponding function.

In Embodiments 1 and 2 (FIG. 3), the second gear 6 is beyond the outer periphery of the container body 1*a* as seen in the longitudinal direction. On the other hand, in this embodiment, as shown in FIG. 29, the second gear 6 is not beyond the outer periphery of the toner supply container as seen in the longitudinal direction of the toner supply container. The sizes of the first gear 5 and the second gear are different.

The driving gear 12 is more inside toward the inside of the container body 1*a* beyond the outer periphery of the container body 1*a*, as compared with the foregoing embodiments.

The center of rotation of the second gear 6 is away from the center of rotation of the toner supply container in the radial direction, so that shaft portion thereof is eccentric. With this structure, the automatic rotation of the toner supply container is accomplished similarly to Embodiments 1 and 2.

The structure of this embodiment wherein the first gear 5 and the second gear 6 are not projected beyond the outer periphery of the container body 1*a*, is preferable from the standpoint that packaging property of the toner supply container 1 is good, and therefore, the occurrence probability of damage during transportation or supplying operation can be lowered.

[Embodiment 10]

Figure 30:
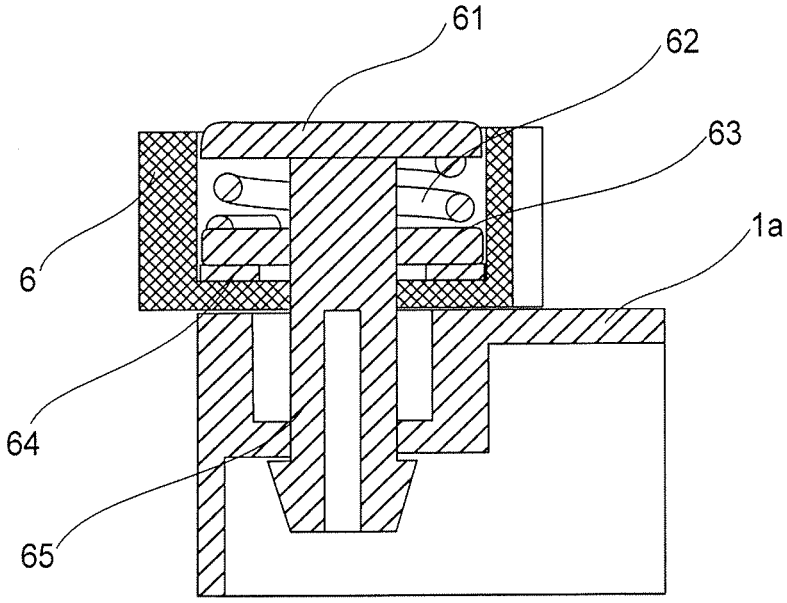
FIG. 30 is a sectional view of a supporting structure for the second gear 6.

Referring to FIG. 30, a toner supply container 1 according to Embodiment 10 will be described. The basic structures of the container are the same as Embodiments 1 and 2, and therefore, the description of the detail structures thereof is omitted for the sake of simplicity. In the Figures, the same reference numerals as in Embodiment 1 are assigned to the element having a corresponding function.

In Embodiments 1 and 2, the rotation shaft of the second gear 6 is rotatably supported on the container body 1*a*, but in this embodiment, as shown in FIG. 30, the hole portion of the second gear 6 is supported on the container body 1*a*.

More particularly, the second gear 6 is provided at the center of rotation with a bearing portion (bearing hole), and a cap-like member 61 is engaged into the container body 1*a* and penetrates the bearing portion.

More particularly, as shown in FIG. 30, the bearing portion for the second gear 6 is locked and secured in the hole portion formed in an end surface of the container body 1*a* by an engagement shaft member 65. The second gear 6 is in the form of a cup in which a ring member 64 (sliding member, elastic member) of silicone rubber as a rotation resistance applying means is provided and is compressed to a predetermined degree. The ring member 64 of silicone rubber is compressed between the spring (urging member) 62 and the bottom surface of the cup portion of the second gear 6 through a pressing member 63 (urging member). The pressing member 63 is fixed on the engagement shaft member 65. The cap-like member 61 (urging member) is fixed to the engagement shaft member 65 so that the spring 62 is compressed between the cap-like member 61 and the pressing member 63.

Thus, the rotation resistance of the second gear 6 relative to the container body 1*a* is set to be sufficiently large.

With such a structure, the resistance against the sliding between the ring member 64 and the second gear 6 is enhanced, so that second gear 6 is not easily rotated relative to the container body 1*a*.

The hole portion of the container body 1*a* in which the engagement shaft member 65 is inserted, is disposed at a position away from the rotational center of the container body 1*a*. That is, the center of rotation of the second gear 6 is disposed eccentrically from the rotational center of the container body 1*a*, and is supported on the container body 1*a* through the engagement shaft member 65. The first gear 5 has structures similar to those of Embodiments 1 and 2. The structure of the rotation resistance applying means can be properly modified similarly to Embodiment 1.

With such a structure of this embodiment, the advantage effects similar to those of Embodiments 1 and 2 can be provided.

[Embodiment 12]

Figure 31:
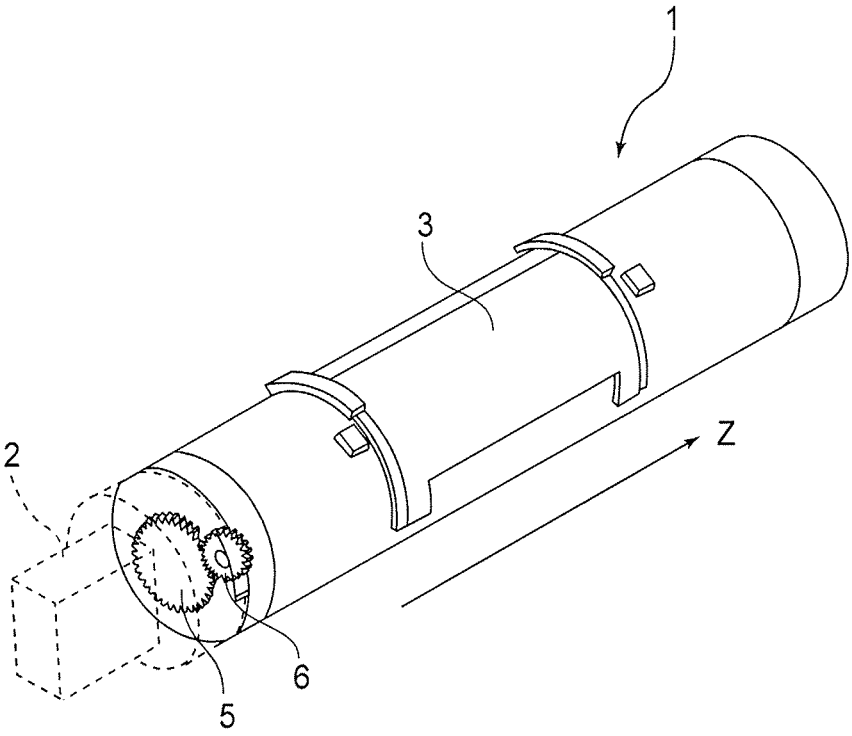
FIG. 31 is a perspective view of a toner supply container most of the drive transmission gears are covered with a grip member.

Referring to FIG. 31, a toner supply container 11 according to Embodiment 2 will be described. The basic structures of the container are the same as Embodiments 1 and 2, and therefore, the description of the detail structures thereof is omitted for the sake of simplicity. In the Figures, the same reference numerals as in Embodiment 2 are assigned to the element having a corresponding function.

In the Embodiment 2 described above, the toner supply container 1 is inserted into the toner receiving apparatus 10 with the gears 5 and 6 at the leading side, but in this embodiment, as shown in FIG. 31, the toner supply container 1 is inserted into the toner receiving apparatus 10 with the gears 5 and 6 at the trailing side.

More particularly, the gears 5 and 6 are provided on a trailing edge of the toner supply container 1 with respect to the inserting direction, and the operation handle 2 is mounted such that connecting portion between the gear 6 and the driving gear 12 is exposed.

With such a structure, the drive transmitting means (gears 5, 6) can be protected by the handle 2, and therefore, is advantageous in this respect.

The structure of the toner reception apparatus side is different correspondingly to the toner supply container, and for example, the driving gear 12 and so on are provided at front.

In this embodiment having a different mounting direction of the toner supply container into the toner receiving apparatus, the same advantage effects can be provided.

The present invention is not limited to these examples, and can be modified. For example, the toner supply container of the Embodiment 2 may be such that it is mounted from the top side of the toner receiving apparatus similarly to Embodiment 1. The drive transmitting means provided on the outer cylinder of the toner supply container in Embodiment 3 may be replaced with the drive transmitting means for the toner supply container in Embodiment 4.

COMPARISON EXAMPLE

The toner supply container 1 of Embodiment 1 will be compared with a toner supply container of comparison example (FIG. 32) which has only the gear 5 (without the gear 6) of Embodiment 1.

Figure 32:
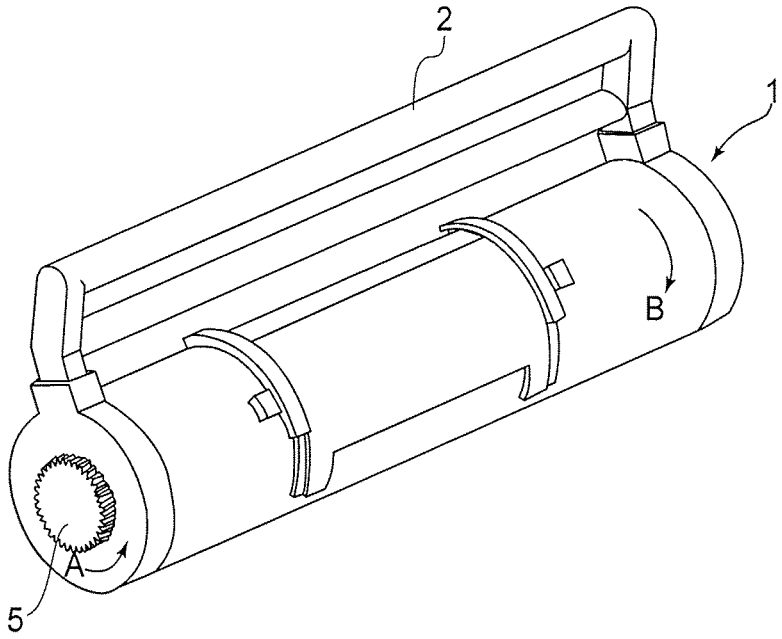
FIG. 32 is a perspective view of a toner supply container of a comparison example.

As contrasted to Embodiment 1, the gear 5 of the toner supply container 1 of the comparison example shown in FIG. 32 is engaged with the driving gear 12 of the toner receiving apparatus 10 at the time when it is inserted into the main assembly of the image forming apparatus 100. The rotating direction of the toner supply container required for the setting operation of the toner supply container is indicated by an arrow B, and the rotational direction of the gear 5 (feeding member 4) is indicated by an arrow A.

In the case of such a structure, the teeth of one of the gears may abut the teeth of the other gear during the mounting operation of the toner supply container, with the result of deterioration or damage of the gear 5 of the toner supply container and the driving gear of the toner receiving apparatus.

In the case of the structure of the comparison example, the rotational direction B of the toner supply container and the rotational direction A of the gear 5 (feeding member 4) are opposite to each other. Therefore, if the degree of rotation of the toner supply container by the user is insufficient, the insufficiency cannot be dealt with as in Embodiment 1.

Even if the rotation of the toner supply container is properly carried out, the toner supply container may be rotated in the direction opposite from the rotational direction of the toner supply container during the setting operation due to the load provided by the rotation of the feeding member 4, during the toner supply step. If this occurs, the amount of toner supply may be short which leads to various problems. Particularly, when the flowability of the toner is low, depending on the ambient condition of high temperature and high humidity ambience or the like, or the property of the toner, the decrease of the amount of the toner supply is remarkable. The reason is considered as follows.

Figure 33:
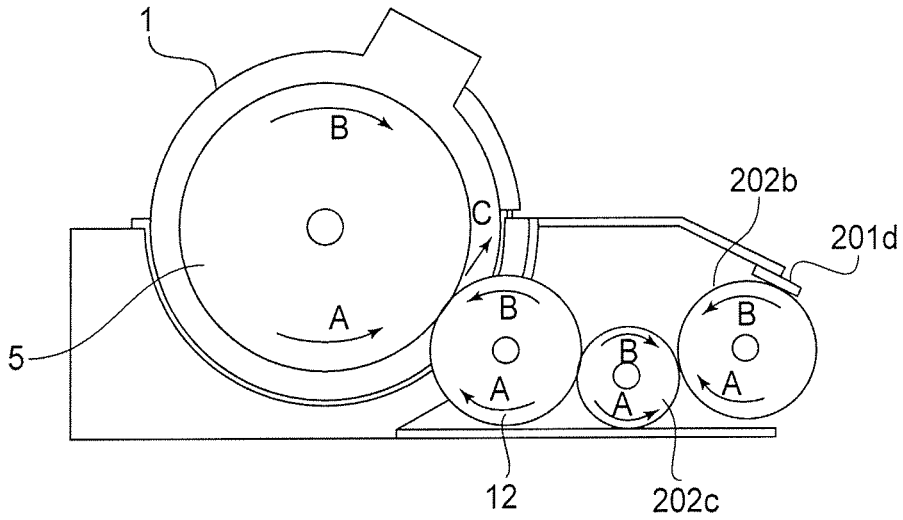
FIG. 33 is a sectional side view of a driving force transmitting means of the toner supply container of the comparison example after it is mounted to the toner receiving apparatus.

In the case of the structure of the comparison example, during the toner supply step (during the transmission of the rotational driving force to the gear 5 in the rotational direction A in FIG. 33), the feeding member 4 and the container body 1*a* is imparted with the forces (arrow C in FIG. 33), in the direction same as the direction of the force received from the driving gear 12, through the friction between the stirring shaft

4*a* and the bearings of the container body 1*a* therefor and through the friction between the stirring blade 4*b* and the inner surface of the container body 1*a*.

In order to solve this problem, a mechanism is required to regulate the rotation of the container body 1*a* in the direction A, with the result of increase in cost.

In the case of the comparison example, the drive transmission is possible even when the toner discharge opening 1*b* and the toner receiving opening 10*b* are not yet unsealed, or are not aligned with each other. If the drive transmission occurs in this state, the toner is not supplied into the toner receiving apparatus 10. Since the toner discharge opening 1*b* is sealed by the container shutter 3, the toner is unable to move with the result that toner in the container is unnecessarily frictioned with the feeding member 4, and coarse particles of toner are generated.

INDUSTRIAL APPLICABILITY

According to the present invention, it is possible to provide a developer supply container with which a deterioration of a drive transmission member can be suppressed.

It is also possible to provide a developer supply container which is contributable to suppression to a deterioration of a driving gear of a developer receiving apparatus.

It is further possible to provide a toner supply container which can properly supply the developer.

While the invention has been described with reference to the structures disclosed herein, it is not confined to the details set forth and this application is intended to cover such modifications or changes as may come within the purpose of the improvements or the scope of the following claims.

The invention claimed is:

1. A developer supply container detachably mountable to a developer receiving apparatus including a driving gear, said container comprising:

a substantially cylindrical container configured to contain a developer, said cylindrical container having a developer discharging opening formed on a peripheral portion thereof;

a developer feeding blade provided in said cylindrical container and configured to feed the developer in said cylindrical container toward said developer discharging opening by rotation thereof relative to said cylindrical container when said cylindrical container is positioned at a developer discharging position;

a stepped gear engageable with the driving gear and rotatable about an axis thereof to receive a rotational force for rotating said developer feeding blade from the driving gear;

a drive relaying gear, disposed co-axially with a rotation shaft for said developer feeding blade, configured and positioned to relay a drive transmission force between said stepped gear and said rotation shaft;

a regulating projection configured and positioned to regulate a mounting attitude of said cylindrical container relative to the apparatus so as to prevent an engagement between said stepped gear and the driving gear, and thereafter upon mounting said cylindrical container, said stepped gear being revolvable, with manual rotation of said cylindrical container, in a setting direction about a rotation center of said cylindrical container to a set position where said stepped gear is engageable with the driving gear; and a load applier configured and positioned to apply a load to said stepped gear to rotate said cylindrical container from the set position to the developer discharging position by the rotational force received by said stepped gear.

2. A container according to claim 1, wherein said stepped gear has a rotation center which is deviated from a rotation center of said cylindrical container.

3. A container according to claim 1, wherein said load applier applies the load to said stepped gear through said drive relaying gear.

4. A container according to claim 1, wherein said regulating projection regulates the mounting attitude of said cylindrical container so as to upwardly orient said developer discharging opening.

5. A container according to claim 4, wherein said developer discharge opening is positioned to be in communication with a developer receiving opening provided in the apparatus with rotation of said cylindrical container from the set position to the developer discharging position in the setting direction by the rotational force.

6. A container according to claim 1, further comprising a hook provided on a peripheral surface of said cylindrical container and configured to be in hooking engagement with a shutter of the apparatus for openably closing the developer receiving opening, wherein said hook interrelates the rotation of said cylindrical container from the set position to the developer discharging position in the setting direction and an opening operation of the shutter.

7. A container according to claim 1, wherein said regulating projection regulates the mounting attitude of said cylindrical container so that said cylindrical container is insertable into the apparatus substantially along an axial direction of said cylindrical container.

8. A container according to claim 1, further comprising a stopper configured and positioned to stop the manual rotation of said cylindrical container in the setting direction at the set position.

9. A container according to claim 8, wherein said stopper stops rotation of said cylindrical container from the set position in the setting direction at the developer discharging position.

* * * * *